US008262216B2

(12) United States Patent
Hamano et al.

(10) Patent No.: US 8,262,216 B2
(45) Date of Patent: Sep. 11, 2012

(54) INKJET PRINTING APPARATUS, LIQUID APPLICATION MECHANISM AND METHOD OF CONTROLLING THE LIQUID APPLICATION MECHANISM

(75) Inventors: Tetsu Hamano, Tokyo (JP); Junichi Yoshikawa, Tokyo (JP); Tsuyoshi Saeki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 12/778,627

(22) Filed: May 12, 2010

(65) Prior Publication Data

US 2010/0295889 A1 Nov. 25, 2010

(30) Foreign Application Priority Data

May 19, 2009 (JP) ..... 2009-121159

(51) Int. Cl.
*B41J 2/01* (2006.01)

(52) U.S. Cl. ..... 347/103; 347/101; 118/679

(58) Field of Classification Search ..... 347/98, 347/101, 103; 118/679
See application file for complete search history.

(56) References Cited

U.S. PATENT DOCUMENTS

| | | | | |
|---|---|---|---|---|
| 7,604,344 | B2 * | 10/2009 | Seki et al. | 347/103 |
| 7,963,245 | B2 * | 6/2011 | Oshio et al. | 118/679 |
| 2007/0034102 | A1 | 2/2007 | Oshio et al. | |

FOREIGN PATENT DOCUMENTS

| | | | |
|---|---|---|---|
| JP | 2002-096452 | A | 4/2002 |
| JP | 2007-044650 | A | 2/2007 |

* cited by examiner

*Primary Examiner* — Lam S Nguyen
(74) *Attorney, Agent, or Firm* — Fitzpatrick, Cella, Harper & Scinto

(57) ABSTRACT

Even if a liquid is attached and solidified on a peripheral surface of a coating roller, application of the liquid on a medium is uniformly performed. At least a part of contacting member is separated from the coating roller and the coating roller is rotated in a second direction as a reverse direction to a first direction to pull out the liquid from a liquid retaining space onto the coating roller. Next, by interrupting the above separation and rotating the coating roller in the first direction, a liquid reservoir is formed in the periphery of a contacting portion between the coating roller and the contacting member.

9 Claims, 16 Drawing Sheets

INKJET PRINTING APPARATUS, LIQUID APPLICATION MECHANISM AND METHOD OF CONTROLLING THE LIQUID APPLICATION MECHANISM

BACKGROUND OF THE INVENTION

1. Field of the Invention

The present invention relates to a liquid application mechanism and an inkjet printing apparatus including the liquid application mechanism.

2. Description of the Related Art

There is known a system such as a spin coater, a roll coater, a bar coater or a die coater as an application mechanism for coating a medium with a liquid or a liquid material. In the field of inkjet printing apparatuses, there is proposed an inkjet printing apparatus with an application mechanism for in advance applying a reaction liquid on a print medium to improve a print concentration or reduce bleeding thereon.

For example, Japanese Patent Laid-Open No. 2002-96452 has proposed an application mechanism in which a rotational operation of a coating roller is performed for each given time during a stand-by condition, thus preventing a coating liquid attached on the coating roller from being solidified. In addition, Japanese Patent Laid-Open No. 2007-44650 has disclosed an application mechanism in which a roller is rotated to supply a coating liquid from a retaining member of the coating liquid to a peripheral surface of the roller, and a liquid reservoir is formed in a contacting portion between the roller and the retaining member of the coating liquid by performing a rotational operation of the roller before performing an application operation thereof. By in advance forming the liquid reservoir of the coating liquid in the contacting portion between the roller and the retaining member of the coating liquid in this way, the coating liquid acts as a lubricant, reducing wear of the roller generated at the time a part of the peripheral surface of the roller is in contact with the retaining member of the coating liquid.

However, in a case where the rotational operation of the coating roller is designed to be performed for each given time during the stand-by condition of the application mechanism as disclosed in Japanese Patent Laid-Open No. 2002-96452, even if the application mechanism is left in a state where the power of the application mechanism is OFF, it is required to perform rotation of the coating roller for each given time. Accordingly, since the rotational operation of the coating roller is performed for each given time even in a case where the power of the application mechanism is OFF, separate recovery means such as a built-in power source is required in the application mechanism. In consequence, a structure of the apparatus is complicated, leading to an increase in manufacturing cost of the apparatus. In addition, Japanese Patent Laid-Open No. 2002-96452 describes a technology in which the coating roller is operated to be dipped in the coating liquid as an initial process of the application operation or the coating roller is operated to be separated away from a counter roller at the stand-by time of the coating roller. However, even if the application mechanism is assumed to perform such an operation, it is difficult to remove the liquid attached on the coating roller after the previous application operation is completed. Therefore, at the time of performing the next application operation, it is required to remove the solidified coating liquid left on the coating roller.

Further, as disclosed in Japanese Patent Laid-Open No. 2007-44650, in regard to the method of taking a measure against the wear of the roller by in advance forming the liquid reservoir in the contacting portion between the roller and the retaining member, it is difficult to adjust an amount of the coating liquid forming the liquid reservoir. Therefore, there is a possibility that the coating liquid is collected in the retaining member due to a negative pressure inside the retaining member. Therefore, there are some cases where it is difficult to in advance form the liquid reservoir having an amount of the coating liquid effective for reducing the wear of the roller in the periphery of the contacting portion between the roller and the retaining member.

SUMMARY OF THE INVENTION

Therefore, the present invention is made in view of the foregoing problem, and an object of the present invention is to provide a liquid application mechanism and a method of controlling the liquid application mechanism in which even if a liquid is attached on a peripheral surface of a coating roller and is then solidified thereon, it is possible to perform an application of the liquid in a state where the peripheral surface of the coating roller is smooth at the time the liquid application is performed.

According to a first aspect of the present invention, there is provided a liquid application mechanism comprising: a coating roller; and a member contacting with the coating roller to form a space retaining a liquid between the member and the coating roller, wherein a medium is conveyed by rotating the coating roller in a first direction to apply the liquid reserved in the space on the medium, wherein the liquid application mechanism includes a mechanism for separating at least a part of the member from the coating roller, and in a state where at least a part of the member is separated from the coating roller by the mechanism, the coating roller is rotated in a second direction as a reverse direction to the first direction, and the rotating in the second direction enable to pull out the liquid from the space onto the coating roller.

According to a second aspect of the present invention, there is provided an inkjet printing apparatus comprising: the liquid application mechanism as described above; and printing means for printing an image on the medium by ejecting ink from a print head to the medium on which the liquid is applied by the liquid application mechanism.

According to a third aspect of the present invention, there is provided a method for controlling a liquid application mechanism, the liquid application mechanism comprising: a coating roller; and a member contacting with the coating roller to form a space retaining a liquid between the member and the coating roller, wherein a medium is conveyed by rotating the coating roller in a first direction to apply the liquid reserved in the space on the medium, the method comprising the steps of: rotating the coating roller in a second direction as a reverse direction to the first direction in a state of separating at least a part of member from the coating roller to pull out the liquid from the space onto the coating roller; and after the above step, rotating the coating roller in the first direction in a state where the member and the coating roller are in contact with each other by interrupting the separation therebetween to reserve the liquid pulled by the above step in the periphery in a contacting position between the coating roller and the member and form a liquid reservoir.

According to the present invention, the coating liquid attached and solidified on the peripheral surface of the coating roller is dissolved to make the peripheral surface of the coating roller be in a more smooth state, and in that state, the application operation of the liquid can be performed. In consequence, the application of the liquid on a medium can be more uniformly performed. Further, biased wear of the coating roller, leakage of the liquid or occurrence of abnormal noises can be restricted to improve durability of the liquid application mechanism.

Further features of the present invention will become apparent from the following description of exemplary embodiments (with reference to the attached drawings).

BRIEF DESCRIPTION OF THE DRAWINGS

FIG. 5A and FIG. 5B are partial cross sections each showing a coating roller, a liquid retaining member and the like;

FIG. 7 is a perspective view showing the coating roller, a counter roller, the liquid retaining member and the like;

DESCRIPTION OF THE EMBODIMENTS

Figure 1:
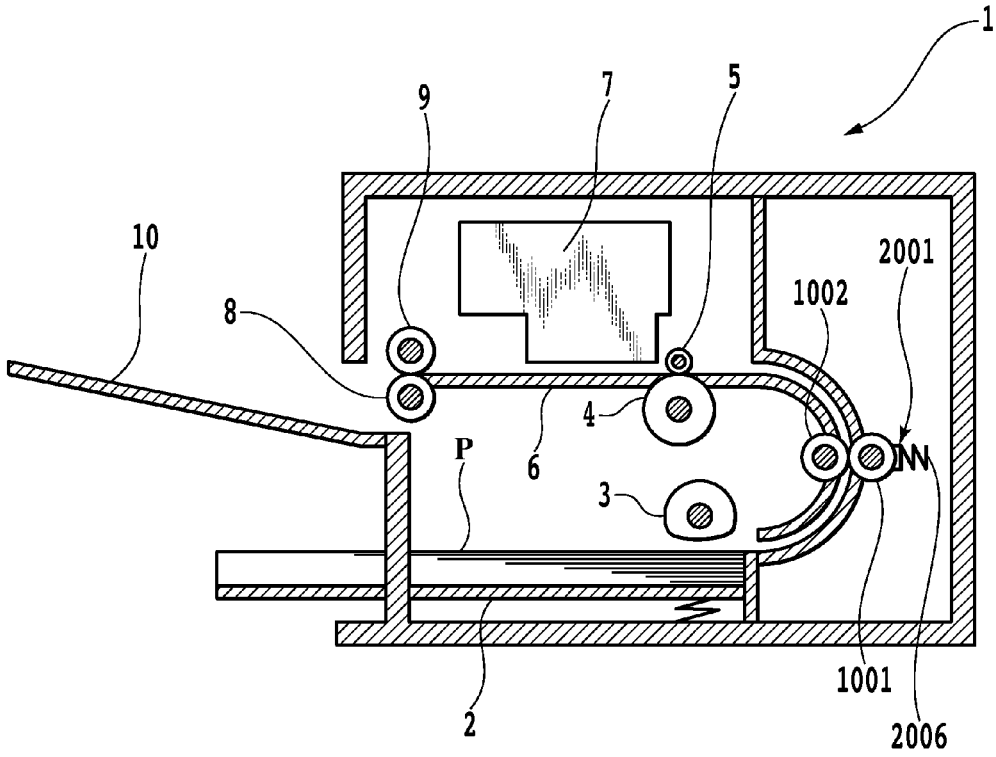
FIG. 1 is a cross section showing an entire arrangement of an inkjet printing apparatus.

Hereinafter, embodiments for carrying out the present invention will be explained with reference to the accompanying drawings. It should be noted that identical codes used over the respective drawings denote the identical or corresponding components. FIG. 1 shows an example of a schematic arrangement of an inkjet printing apparatus 1 equipped with a liquid application mechanism. The inkjet printing apparatus 1 is provided with a feeding tray 2 for loading a medium P composed of a plurality of sheets as a coated medium on which a liquid will be applied from now on, wherein a semicircular separate roller 3 separates the sheets of the medium P loaded on the feeding tray 2 one by one and feeds the separated sheet to a conveying path. A coating roller 1001 and a counter roller 1002 constituting coating means in the liquid application mechanism are arranged in the conveying path, and the coated medium P fed from the feeding tray 2 is conveyed to between the roller 1001 and the roller 1002. The coating roller 1001 rotates in a clockwise direction in FIG. 1 with rotation of a roller drive motor to apply the coating liquid on a print surface in the coated medium P while conveying the coated medium P. The medium P as the print medium on which the coating liquid is applied is fed between a conveying roller 4 and a pinch roller 5. By rotating the conveying roller 4 in a counterclockwise direction in the figure, the print medium P is conveyed on a platen 6 and moves to a position opposing a print head 7 constituting the print means. The print head 7 is an inkjet print head in which a predetermined number of nozzles for ink ejection are disposed, and performs a scan in a direction intersecting with a conveying direction of the print medium P, as well as ejects ink droplets on the print surface of the print medium P from the nozzle according to print data for printing. This print operation and a predetermined amount of the conveying operation by the conveying roller 9 are alternately repeated to form an image on the print medium. Together with this image forming operation, the print medium P is held between a discharge roller 8 and a discharge spur 9 provided in the downstream side of the scanning area of the print head in the conveying path of the print medium, and rotation of the discharge roller 8 causes the print medium P to be discharged on the discharge tray 10. In this way, the inkjet printing apparatus 1 according to the present embodiment includes print means for printing the image on the coated medium by ejecting ink from the print head 7 to the coated medium applied the coating liquid as described later. A detail of the arrangement of the coating means will be separately described later.

It should be noted that the inkjet printing apparatus may be constituted by adopting a so-called full-line type inkjet printing apparatus for performing a print operation by using an elongated print head in which nozzles ejecting ink are disposed across the maximum width of the print medium. The coating liquid in use is a treatment liquid for quickening cohesion of pigment at the time of printing an image with ink having the pigment as a color material. In the present embodiment, the treatment liquid is used as the coating liquid to cause the treatment liquid to react with the pigment as the color material of the ink ejected on the print medium on which the treatment liquid is applied and quicken the cohesion of the pigment. This encapsulation allows an improvement on the print concentration. Further, reduction or prevention of the bleeding is possible. It should be noted that the coating liquid used in the application mechanism of the present embodiment is not limited to the aforementioned example, and may include other kinds of coating liquids.

Figure 2:
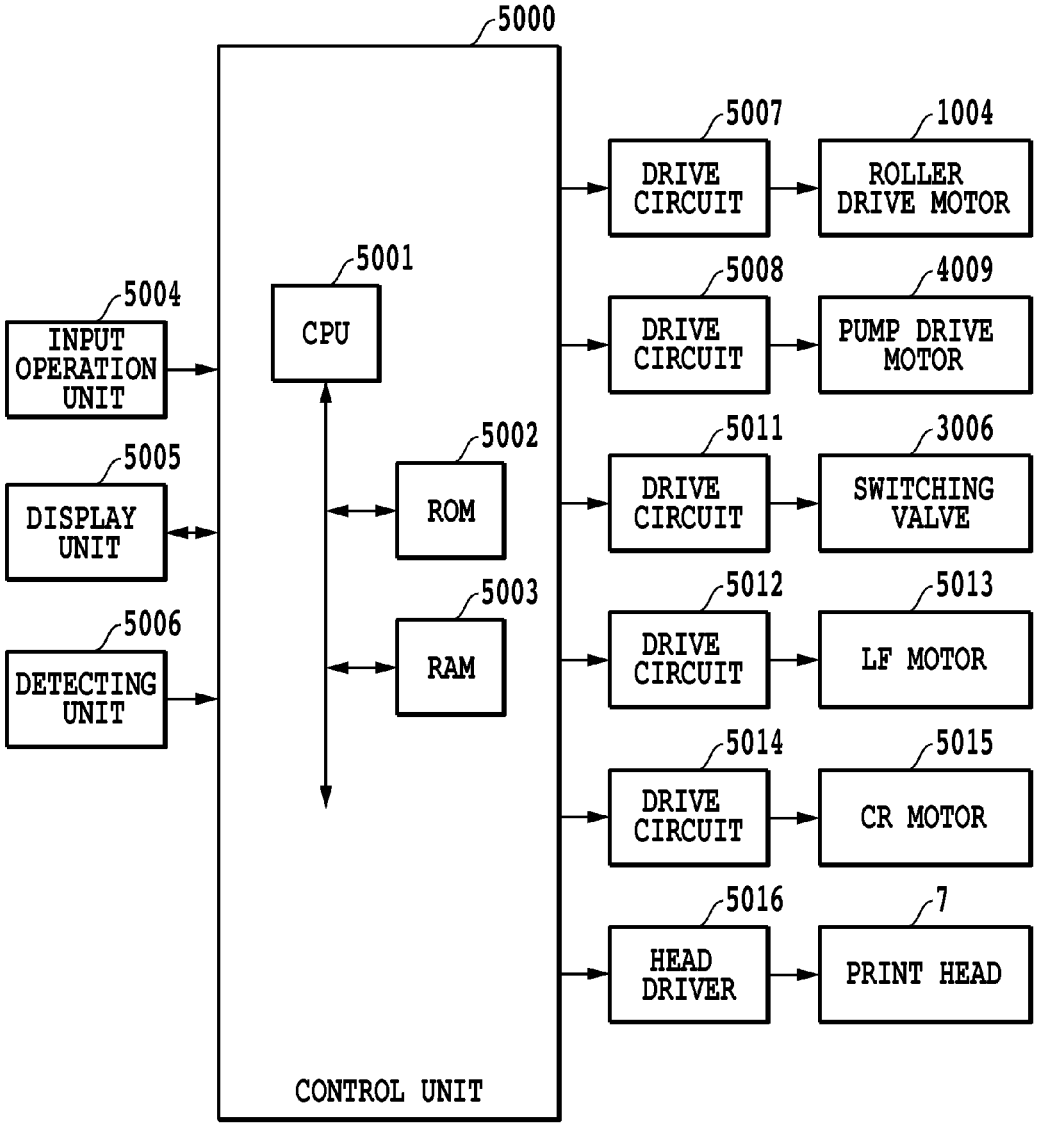
FIG. 2 is a block diagram showing a schematic arrangement of a control system.

FIG. 2 is a block diagram showing a schematic arrangement of a control system of the above inkjet printing apparatus. A control unit 5000 includes a CPU 5001 performing process operations such as various types of calculations, controls, and determinations. In addition, the control unit 5000 includes a ROM 5002 for storing control programs such as a process shown in FIG. 11 which will be described later and a RAM 5003 for temporarily storing data in the middle of the process operation of the CPU 5001 and input data, which are executed by the CPU 5001, and the like. The coating means in the present embodiment controls a rotational drive of the coating roller 1001 or the like, and in the present embodiment, particularly the CPU 5001 acts as the coating means.

An input operation unit 5004 including a key board inputting predetermined commands or data, or various types of switches and a display unit 5005 performing various displays including inputting and setting states of the liquid application apparatus are connected to the control unit 5000. In addition, a detecting unit 5006 including sensors for detecting a position of the coated medium and an operation state of each unit is connected to the control unit 5000. The aforementioned liquid detecting sensor Y001 is a part of the detecting unit 5006. Further, a roller drive motor 1004, a pump drive motor 4009 and first to fifth switching valves respectively are connected through drive circuits 5007, 5008 and 5011 to the control unit 5000.

The CPU 5001 controls a drive of each element of the application mechanism according to a program of the procedure in FIG. 3 described later. In addition, the CPU 5001 controls a LF motor 5013, a CR motor 5015 and a drive of the print head 7 in relation to the print mechanism through the respective drive circuits 5011, 5012 and 5014, and a head driver 5016. That is, the conveying roller 4 or the like is rotated by the drive of the LF motor 5013, and a carriage on which the print head 7 is mounted is moved by the drive of the CR motor 5015. Further, the CPU 5001 performs control of ejecting ink from the nozzle of the print head 7.

Figure 3:
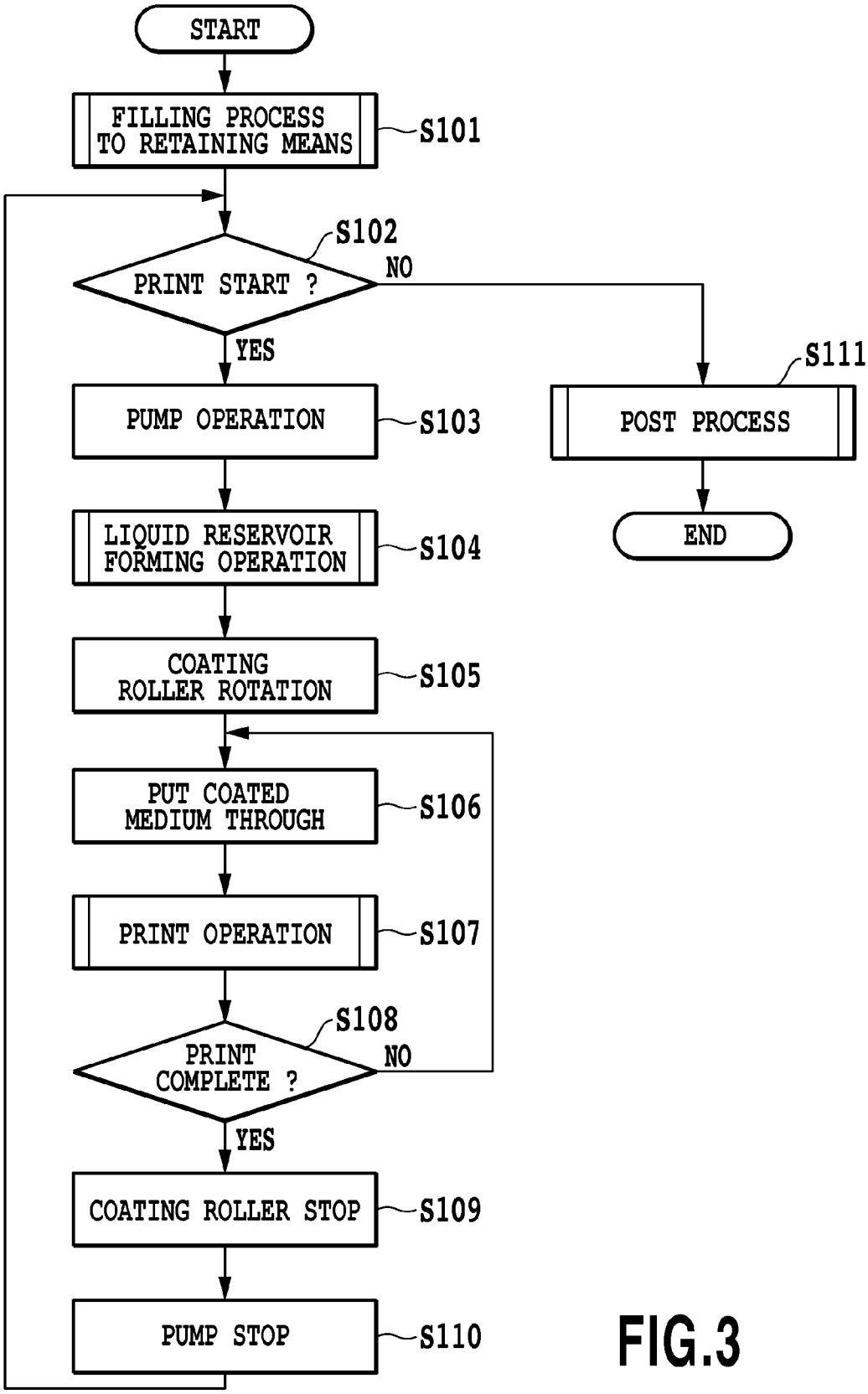
FIG. 3 is a flow chart showing the procedure of an application of a liquid and the subsequent print operation.

FIG. 3 is a flow chart showing the procedure of a liquid application and a print operation in the inkjet printing apparatus of the present embodiment. In FIG. 3, processes at step S101, step S103 to step S106 and processes at step S109 to step S111 are the same as processes at step S1, step S3 to step S6 and step S7 to step S9 shown in FIG. 11, which will be described later. As shown in FIG. 3, when a command of the print start is made in the present embodiment (step S102), a series of liquid application operations such as a pump operation are performed (step S103 to step S106). Further, a liquid is applied on a portion in the coated medium P requiring the liquid application.

In the present embodiment, an operation of forming a liquid reservoir as described later is performed before completing the liquid application operation (step S104). In addition, after completing the liquid application process, a print operation is performed on the print medium P on which a coating liquid is applied (step S107). That is, the print head 7 scans the print medium P which is conveyed by a predetermined amount by the conveying roller 4, and ink is ejected from the nozzles in accordance with print data during the scanning to be impacted on the print medium P, thus forming dots thereon. The ink which is ejected by the print head 7 and impacted on the print medium P reacts with the coating liquid in advance applied on the print medium P. The coating liquid contributes to an improvement of concentration in the printed print image and prevention of exudation thereon.

With repetition of the conveying of the print medium and the scanning of the print head, the print is performed on the print medium P and the print medium P on which the print is completed is discharged on the discharge tray 10. Thereafter, when it is determined that the print is completed at step S108, processes after step S109 are executed to complete the liquid application process and the printing process of performing a print on the print medium P.

It should be noted that in the present embodiment, along with the liquid application onto the print medium, the print is sequentially performed on a portion on which the liquid application is completed. In the present embodiment, a length of the conveying path leading from the coating roller to the print head is shorter than that of the print medium. When the portion of the print medium on which the liquid is applied arrives at a scan area by the print head, the coating is applied by the application mechanism on a portion of the print medium other than the portion thereof on which the print is performed. In this way, the application mechanism in the present embodiment sequentially performs the liquid application and the print on a different portion of the print medium for each predetermined feeding amount of the print medium.

The present invention is not limited to the present embodiment on its application and may perform the print after the application on a single print medium is completed. In addition, in the printing apparatus according to the present invention, it is possible to improve a whiteness degree of the medium by applying a liquid containing a fluorescent bleach by the liquid application mechanism. At this time, the print means after the liquid application is completed can obtain the effect not only with the inkjet printing process but also a printing process such as a thermal-transfer process or an electro-photography process.

The present invention may be applied to a printing apparatus of a silver photography process, and in this case, a photographic sensitive material may be applied on the print medium as the coating liquid before printing.

(Arrangement of Liquid Application Portion)

Figure 4:
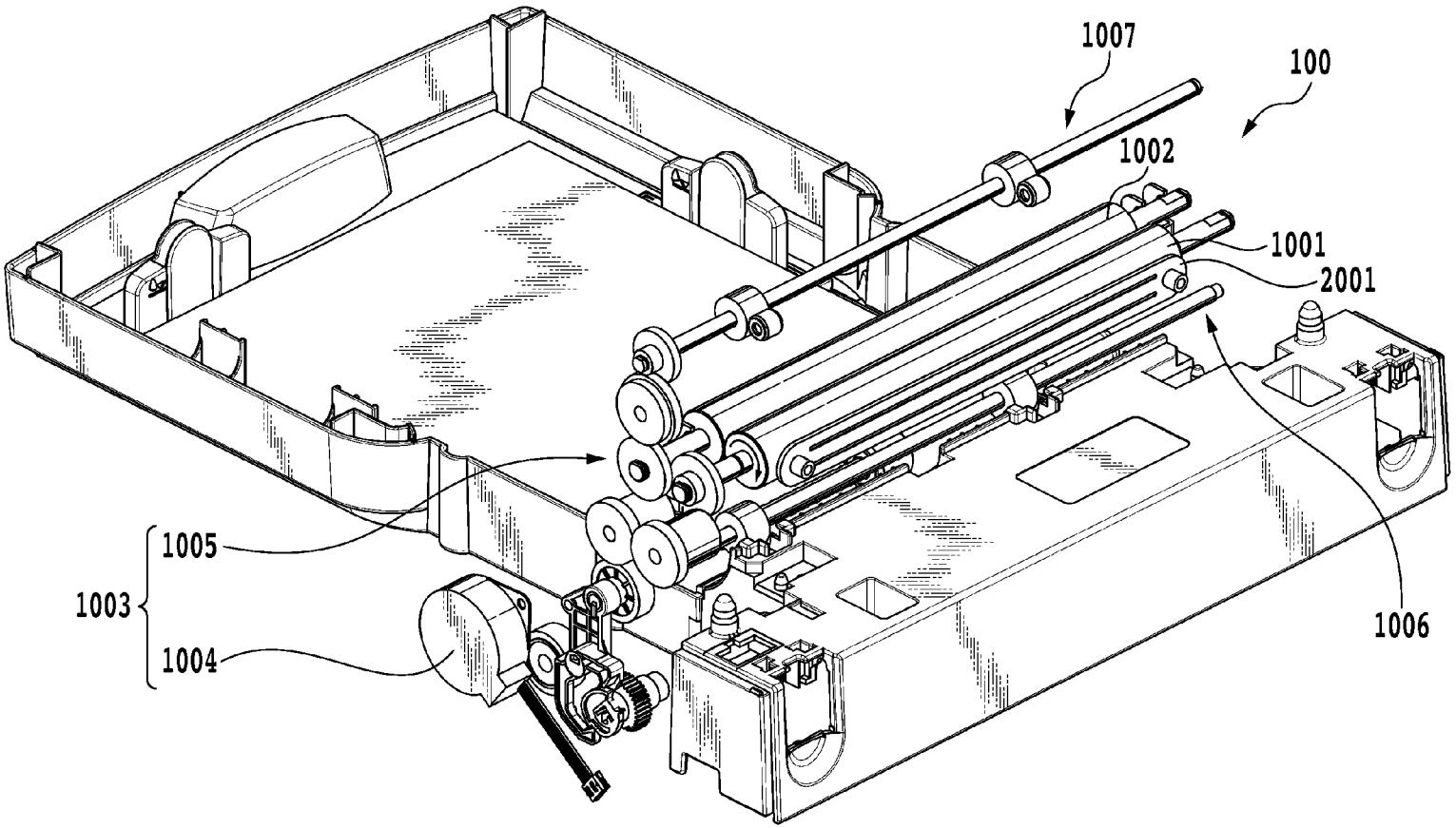
FIG. 4 is a perspective view showing an application mechanism.

FIG. 4 is a perspective view showing an entire arrangement of the liquid application mechanism 100 in the present embodiment. The liquid application mechanism 100 shown herein is configured mainly by including the coating means for applying a predetermined coating liquid on the coated medium and the liquid supplying means for supplying the coating liquid to the coating means.

The coating means includes the cylindrical coating roller 1001, the cylindrical counter roller (medium supporting member) 1002 arranged as opposed to the coating roller 1001 and a roller drive mechanism 1003 for driving the coating roller 1001. The roller drive mechanism 1003 is configured by a roller drive motor 1004 and a power transmission mechanism including a gear train for transmitting a drive force of the roller drive motor 1004 to the coating roller 1001 and the like.

The liquid supplying means is configured by including a liquid retaining member 2001 for retaining the coating liquid between the peripheral surface of the coating roller 1001 and the liquid retaining member 2001 and a liquid flow passage, which will be described later, for supplying a liquid to the liquid retaining member 2001. The coating roller 1001 and the counter roller 1002 are respectively supported on a frame (not shown) in such a manner that both ends of each are rotatably mounted thereon. The coating roller 1001 and the counter roller 1002 are arranged so that axes of rotation are parallel each other.

As shown in FIG. 4, the liquid retaining member 2001 extends over an entirety of the coating roller 1001 in a longitudinal direction thereof. The liquid retaining member 2001 is mounted in such a manner as to be capable of moving relative to a frame (not shown) in the printing apparatus through a mechanism which can control the liquid retaining member 2001 to contact with and separate from the peripheral surface of the coating roller 1001.

Figure 5A:
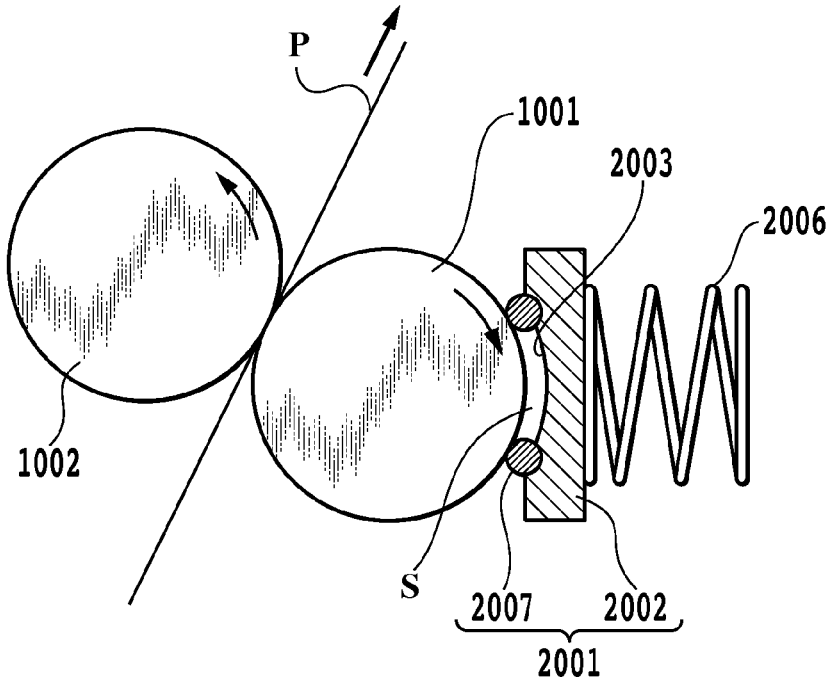
Figure 5B:
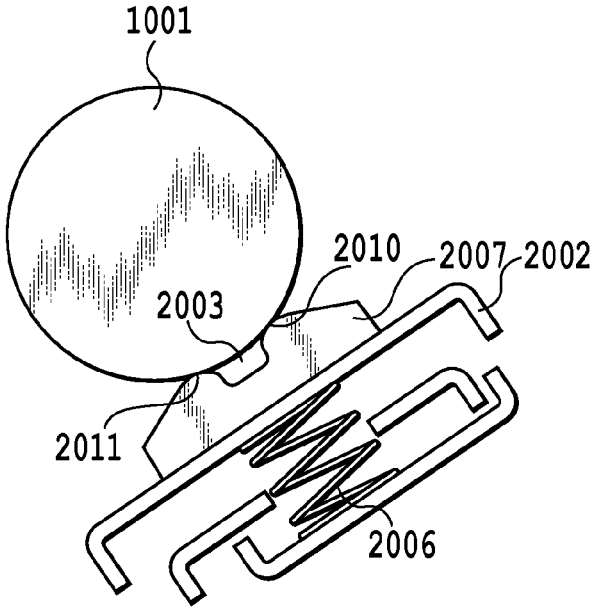

FIG. 5A and FIG. 5B are diagrammatical cross sections for explaining an arrangement of the coating roller 1001, the liquid retaining member 2001 and the like in the present embodiment. It should be noted that FIG. 5A is shown in a diagrammatical way for explanation and an actual configuration and an arrangement thereof are as shown in FIG. 5B. As shown in FIG. 5A, the coating roller 1001 is urged against the peripheral surface of the counter roller 1002 by a spring member (pressing means) 2006. In a case where the coating roller 1001 and the counter roller 1002 are configured in this way, the coated medium P on which the coating liquid should be applied is held between both the rollers. Further, rotation of the coating roller 1001 in a clockwise direction in FIG. 5A causes the coated medium P to be conveyed in an arrow direction in FIG. 5A. In this way, the application mechanism rotates the coating roller 1001 in a conveying direction of the coated medium P as a first direction and conveys the coated medium P to apply the coating liquid reserved in a liquid retaining space S on the coated medium P. Here, in the present embodiment, the medium P at a stage before the coating liquid is applied is called a coated medium and the medium P after the coating liquid is applied is called a print medium.

In the present embodiment, the coating roller 1001 is made of a silicon material having a rubber hardness of 20 degrees, and has a surface roughness Ra of the order of 1.0 to 2.0 μm and a diameter of 23.169 mm. The counter roller 1002 is made of a metallic material and has a diameter of 12 mm.

The liquid retaining member 2001 is urged and contacts against the peripheral surface of the coating roller 1001 by an urging force of the spring member (pressing means) 2006. At this time, the liquid retaining member 2001 is arranged to form the elongated liquid retaining space S extending over the entirety of the liquid application area by the coating roller 1001. The coating liquid is supplied inside the liquid retaining space S through the liquid retaining member 2001 from the coating liquid flow passage and the liquid recirculation portion. At this time, since the liquid retaining member 2001 is configured as follows, it is possible to prevent or reduce accidental leakage of the coating liquid from the liquid retaining space S to an outside in a stop state of the coating roller 1001. Simultaneously it is also possible to restrict vaporization of the coating liquid.

Figure 6:
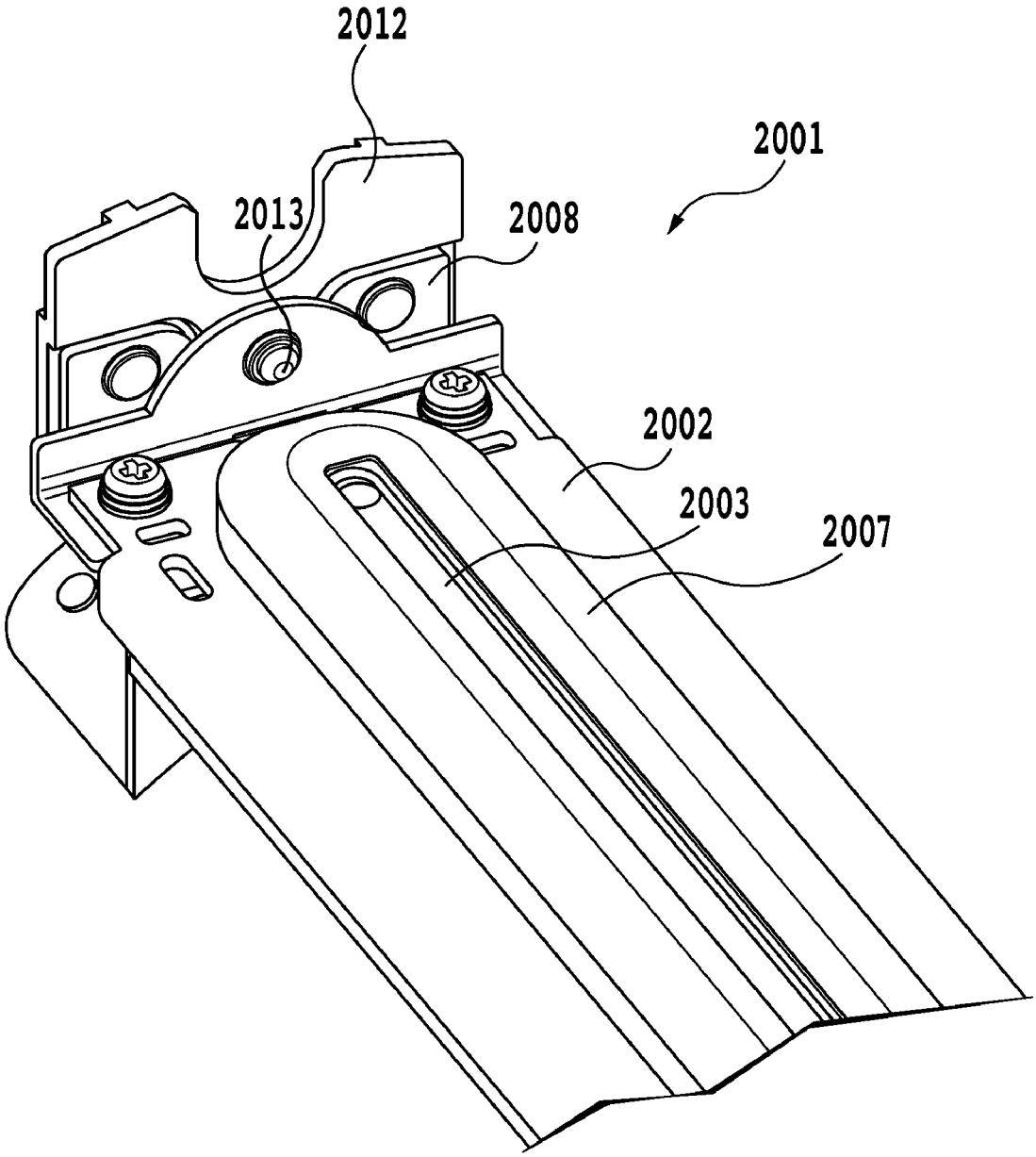
FIG. 6 is an enlarged perspective view showing the liquid retaining member in the application mechanism.

FIG. 6 shows an arrangement of the liquid retaining member 2001. The liquid retaining member 2001 is configure by including a coating cap 2002 (cap sheet plate) and a contacting member 2007 mounted to the coating cap 2002. The contacting member 2007 has end portions in the longitudinal direction each circularly formed. A concave portion 2003 is formed in a central part of the contacting member 2007 in a width direction thereof to extend in the longitudinal direction in such a manner as to be recessed from a portion of the contacting member 2007 contacting against the coating roller 1001. The contacting member 2007 is formed to be capable of being in contact with the peripheral surface of the coating roller 1001 along an edge portion of the concave portion 2003. Therefore, when the contacting member 2007 of the liquid retaining member 2001 contacts against the coating roller 1001, a pressure to be applied on the contacting member 2007 can be uniformed thereon.

As described above, in the liquid retaining member 2001 in the present embodiment, the contacting member 2007 contacts against the coating roller 1001 in a state where the contacting portions between the coating roller 1001 and the contacting member 2007 are sequentially connected in such a manner that no clearance is generated along an outer peripheral surface of the coating roller 1001 between the contacting member 2007 and the coating roller 1001 by the urging force of the spring member 2006. As a result, the liquid retaining space S becomes a substantially closed space formed by the contacting member 2007, one surface of the coating cap 2002 and the outer peripheral surface of the coating roller 1001, and the coating liquid is retained in the space. In a state where rotation of the coating roller 1001 is stopped, a liquid-tight state can be maintained between the contacting member 2007 and the outer peripheral surface of the coating roller 1001 to securely prevent the liquid from leaking to an outside. On the other hand, when the coating roller 1001 rotates, the liquid, as described later, passes through between the outer peripheral surface of the coating roller 1001 and the contacting member 2007 and is attached on the outer peripheral surface of the coating roller 1001 in layers.

Both of right and left side portions of the contacting member 2007 in an longitudinal direction are shaped to be gradually curved as viewed either from an upper face or a side face of the contacting member 2007 as shown in FIG. 6. Therefore, even if the contacting member 2007 is forced to contact against the coating roller 1001 with a relatively strong pressing force, the contacting member 2007 is flexibly deformed substantially uniformly as a whole and a local, large distortion does not occur therein. Accordingly, the contacting member 2007 can contact against the outer peripheral surface of the coating roller 1001 sequentially without any clearance to form the substantially closed space.

Figure 7:
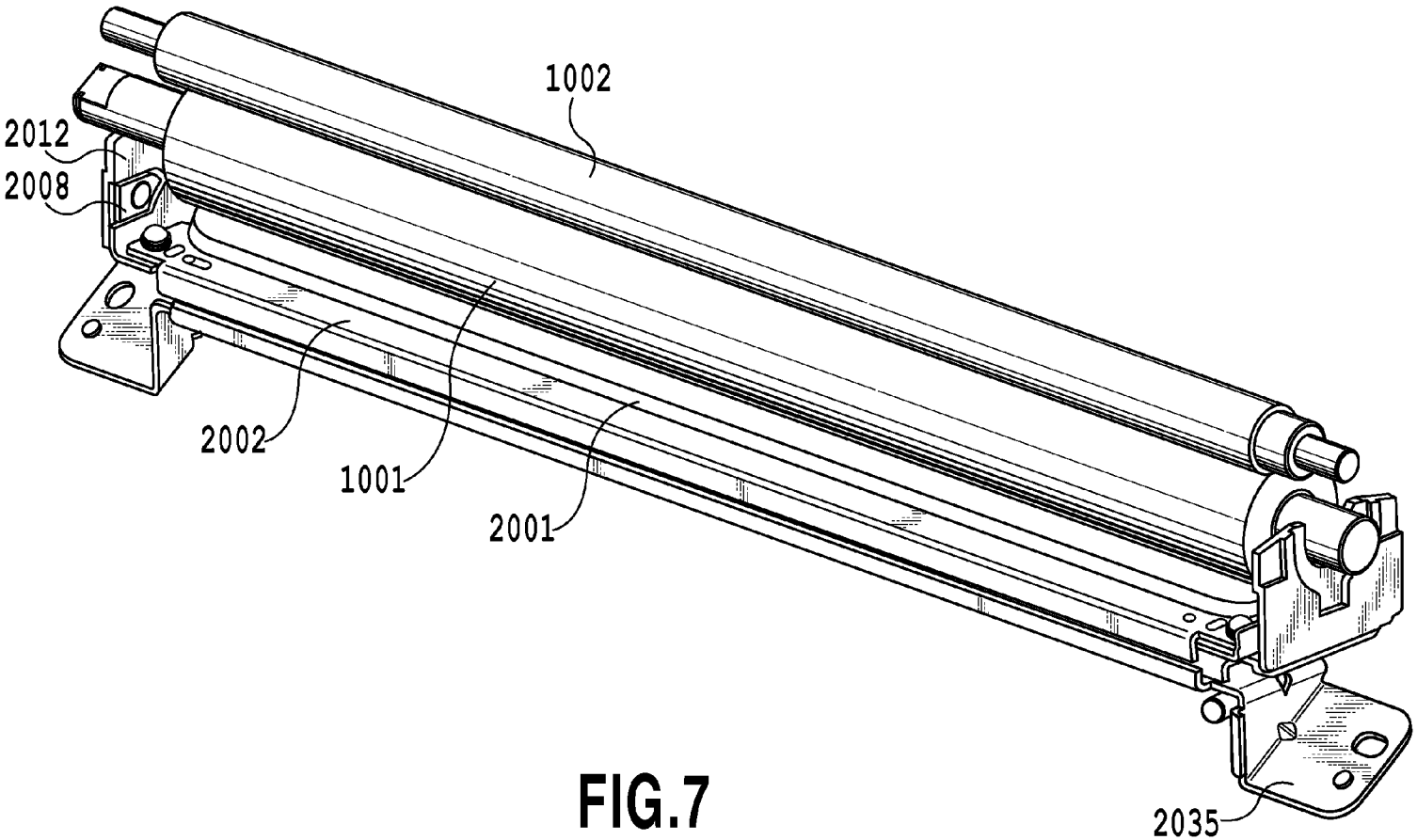

Next, a detail of the structure of the liquid retaining member unit will be explained. As shown in FIG. 6 and FIG. 7, both ends of the coating cap 2002 integral with the liquid retaining member 2001 are screwed to pivot sheet plates 2008 capable of being adjusted in a mounting position thereto in a conveying direction of the print medium P after the pivot sheet plates 2008 are adjusted. The pivot sheet plate 2008 has a hole having a diameter larger than a fitting portion protruding from each of cap arms 2012 as described later such that the cap arm 2012 is fitted into the hole with allowing fluctuation.

The cap arm 2012 has a groove formed in a U-letter shape and is made of resin. The cap arm 2012 acts as a positioning guide in order that the liquid retaining member 2001 can be accurately in position in contact with a part of the arc of the coating roller 1001.

Numeral 2035 denotes a cap stay of the liquid retaining mechanism fixed in a frame in parallel with a central axis of the coating roller 1001. Since the cap arms 2012 are fixed to both side faces of the cap stay 2035 formed in a reverse C-letter shape by heat welding, the right and left cap arms 2012 move together with the cap stay 2035. A fitting axis is provided in each of the right and left cap arms 2012 at a position corresponding to a rotational central hole of the pivot sheet plate 2008, and the liquid retaining member 2001 integral with the pivot sheet plate 2008 is mounted with allowing fluctuation.

In addition, the spring member 2006 is mounted on the cap stay 2035, and urges the coating cap 2002 of the liquid retaining member from the backside to contact the liquid retaining member 2001 against the coating roller 1001 under pressure. As described above, it is required to form the substantially closed space between the coating roller 1001 and the liquid retaining member 2001 and retain the coating liquid in the space. For this purpose, it is desirable to accurately position the coating roller 1001 and the liquid retaining member 2001. The pivot sheet plate 2008 is configured to be capable of adjusting a position relation of the liquid retaining member 2001 to the coating roller 1001. At the time of assembling the liquid retaining member 2001, a jig is used to adjust the U-letter shaped groove of the cap arm 2012 and an axis of the coating roller 1001 fitted into it in such a manner as to have an appropriate position relation therebetween, and the pivot sheet plate 2008 is screwed to the coating cap 2002.

Figure 8:
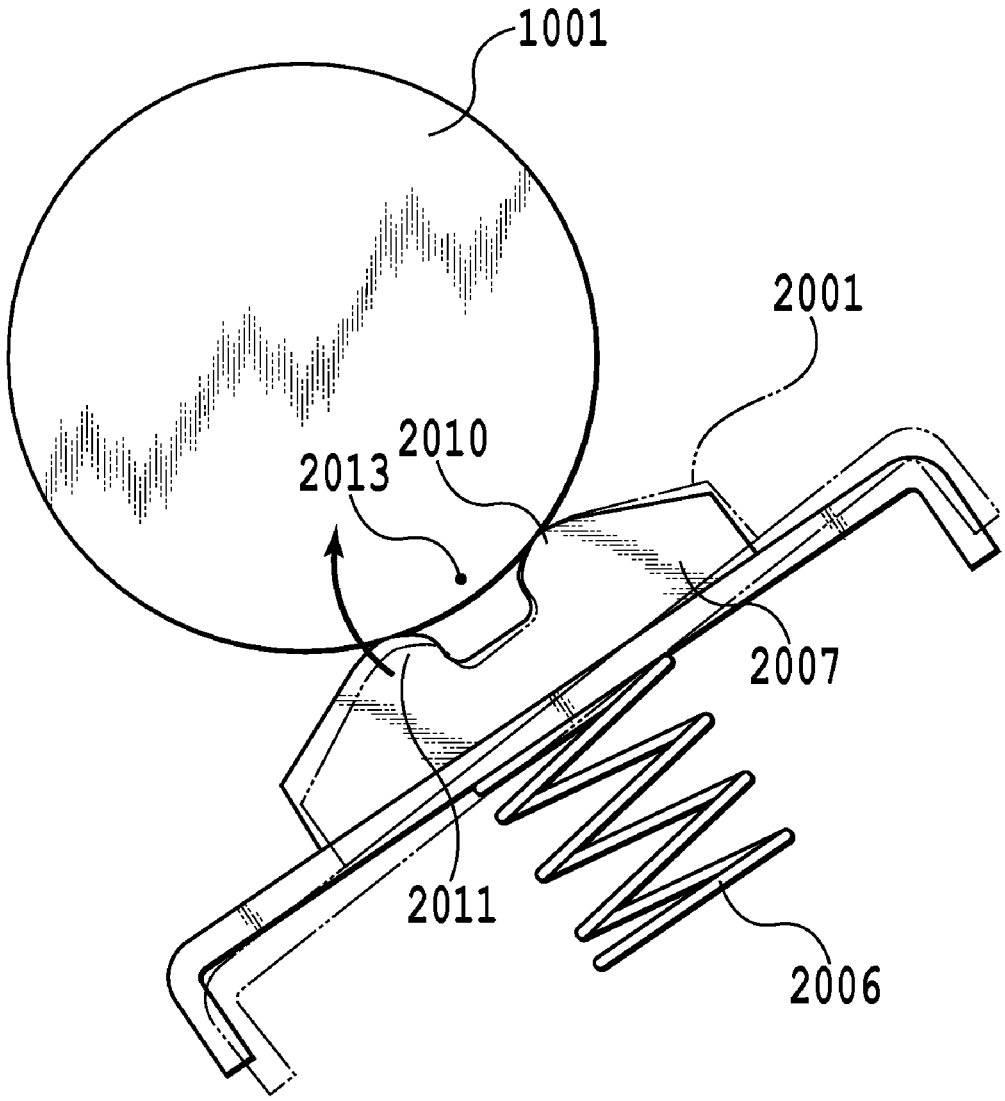
FIG. 8 is a diagram explaining a displacement of the liquid retaining member when the coating roller rotates.

Here, assuming that the liquid retaining member 2001 is not urged by the spring member 2006, there are some cases where there occurs a slight difference in adhesion between an upper edge portion 2010 and a lower edge portion 2011 of the contacting member 2007 between the coating roller 1001 and the liquid retaining member 2001 (FIG. 8). The difference in adhesion between the upper edge portion 2010 (upper edge-side contacting portion) and the lower edge portion 2011 (lower edge-side contacting portion) of the contacting member 2007 is actually easy to occur even if the liquid retaining member 2001 is accurately positioned to the coating roller 1001. However, in the present embodiment, the coating cap 2002 of the liquid retaining member 2001 is urged from the backside by the spring member 2006. Therefore, the liquid retaining member 2001 results in being arranged to rotate around the fitting axis 2013 of the cap arm 2012, and the liquid retaining member 2001 is pressed against the coating roller 1001 in a balanced state. Therefore, it is possible to easily perform accurate positioning between the coating roller 1001 and the liquid retaining member 2001.

Figure 9:
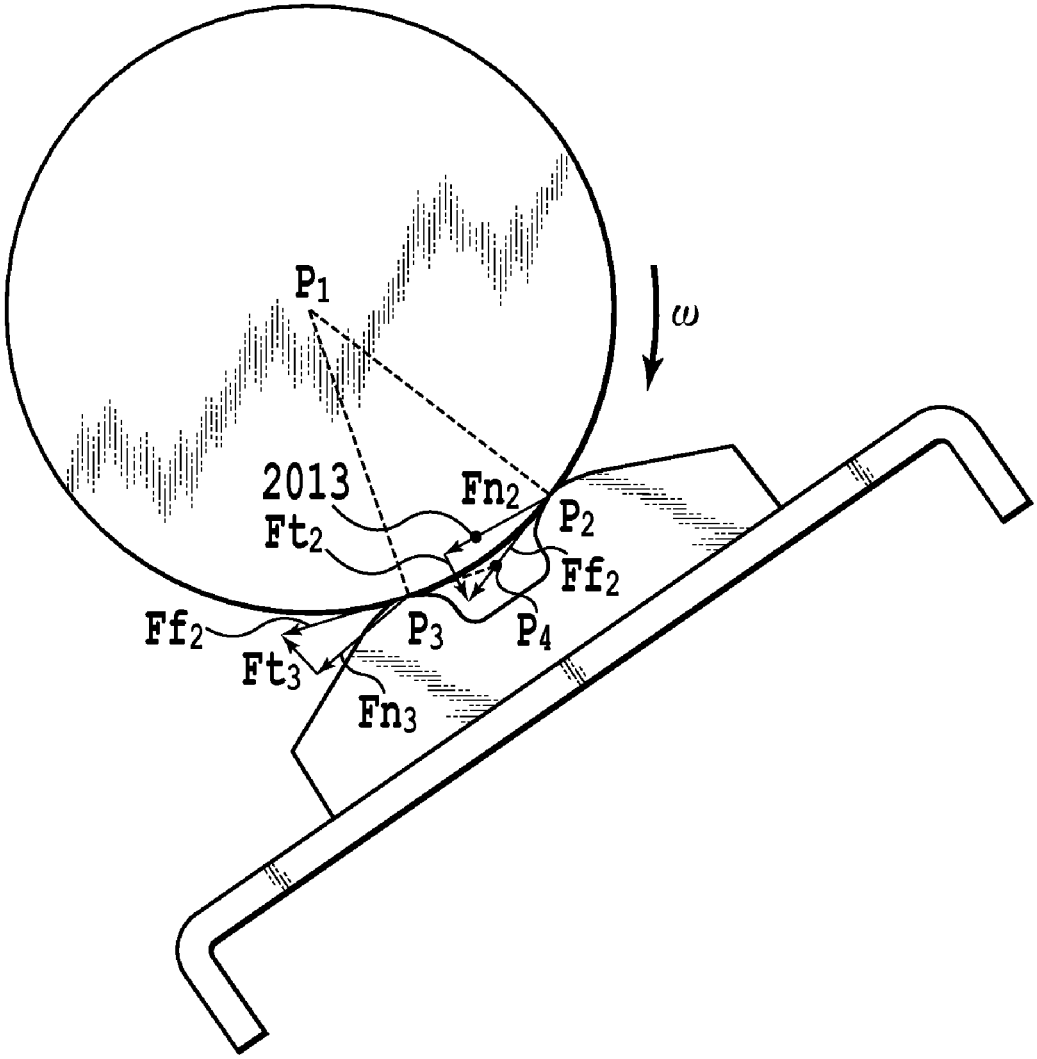
FIG. 9 is a diagram explaining a force exerted on the liquid retaining member when the coating roller rotates.

The fitting axis 2013 of the aforementioned cap arm 2012 is configured in such a manner as to be arranged inside a quadrangle P1P2P4P3 formed by a center P1 of the coating roller 1001, a contact point P2 between the coating roller 1001 and the upper edge portion 2010 of the contacting member 2007, a contact point P3 between the coating roller 1001 and the lower edge portion 2011 of the contacting member 2007 and an intersection point P4 between an outline tangential line of the coating roller 1001 passing through P2 and an outline tangential line of the coating roller 1001 passing through P3 (FIG. 9).

On one hand, in the downstream side of the coating roller 1001 in the rotational direction, it is required to attach a liquid on a surface of the coating roller 1001 uniformly and in a thin film state. Therefore, rotation of the coating roller 1001 causes a force of rotating the liquid retaining member 2001. At this time, a position of the rotational axis of the liquid retaining member 2001 can be set such that a pressing force between the coating roller 1001 and the contacting member 2007 is stably high to stabilize a film thickness of the liquid attached on the coating roller 1001.

In addition, the coating roller 1001 does not simply rotate in one direction all the time and rotates in the reverse direction to the rotational direction at a sheet conveying time in a removal operation of the solidified coating liquid and in a lubricant supplying operation to the contacting portion as described later. Therefore, it is required to set a position of the rotational axis of the coating roller 1001 in consideration of the forward rotation/backward rotation and the like. Accordingly, the rotational center of the liquid retaining member 2001 is arranged inside the quadrangle P1P2P4P3.

A force exerting on the liquid retaining member 2001 at the time the coating roller 1001 rotates will be explained with reference to FIG. 9. When the coating roller 1001 rotates in a sheet conveying direction (ω direction), a friction force F f3 is generated in a tangential direction of the coating roller 1001 at a contact point P3 between the coating roller 1001 and the liquid retaining member 2001. The friction force can be decomposed into a force F n3 in a direction connecting the fitting axis 2013 and the contact point P3 and a force F t3 in a tangential direction perpendicular to the direction of the force F n3. A behavior of the liquid retaining member 2001 may be considered by focusing attention on the component force F t3 in the tangential direction. As apparent in FIG. 9, the component force F t3 in the tangential direction at contact point P3 acts as a force for rotating the liquid retaining member 2001 in such a direction as to get in close contact with the coating roller 1001.

On one hand, a friction force F f2 is generated in a tangential direction of the coating roller 1001 as a force generating at contact point P2. The friction force F f2 can be decomposed into a force F n2 in a direction connecting the fitting axis 2013 and the contact point P2 and a force F t2 in a tangential direction perpendicular to the direction of the force F n2. The behavior of the liquid retaining member 2001 will be considered by focusing attention on the component force F t2 in the tangential direction. As apparent in FIG. 9, the component force F t2 in the tangential direction at contact point P2 acts as a force for rotating the liquid retaining member 2001 in such a direction as to leave away from the coating roller 1001 and weakens the pressing contact force between the liquid retaining member 2001 and the coating roller 1001 to produce a state of furthermore facilitating collection of the liquid.

It should be noted that when the coating roller 1001 rotates in the reverse direction to the sheet conveying direction, the relation between these forces is reversed. That is, at a contact point where the liquid is attached on the coating roller 1001 to supply the coating liquid on the coating roller 1001, a force acts in such a direction that the coating roller 1001 gets in close contact with the liquid retaining member 2001. At a contact point where the liquid which is left on the coating roller 1001 enters into the liquid retaining member 2001 for collection, a force acts in such a direction as to weaken the pressing contact force between the coating roller 1001 and the liquid retaining member 2001.

Next, in regard to the arrangement of the liquid application as explained schematically, each component of the coating liquid flow passage and the liquid recirculation portion and an operation thereof will be in more detail explained.

(Composition of Coating Liquid)

Next, a composition of the coating liquid in the present embodiment will be explained. It should be noted that the coating liquid used in the present embodiment is a liquid aimed at quickening cohesion of pigment upon printing in ink using the pigment as a color material.

An example of components of a liquid used for coating will be described as follows.

| | |
|---|---|
| Calcium nitrate tetrahydrate | 10% |
| Glycerin | 42% |
| Surface-active agent | 1% |
| Water | the rest |

In addition, viscosity of the coating liquid is 5 to 6 cp (centi poise) at a temperature of 25° C. The coating liquid in an application of the present invention is not limited to the above example. For example, as another coating liquid, it is possible to use a liquid containing a component for encapsulation or cohesion of dye. In addition, as a different coating liquid, it is possible to use a liquid containing a component for restricting curl of a coated medium (phenomenon where a medium is formed in a bent shape).

In a case where the coating liquid as a liquid for application is used in a state of containing water, it is desirable that the coating liquid contains a component reducing a surface tension for improving sliding performance at contacting portions between the coating roller and the liquid retaining member in the present invention. In the example of the components in the aforementioned coating liquid, the glycerin and the surface-active agent are components for reducing the surface tension of water.

(Flow Passage Arrangement)

Figure 10:
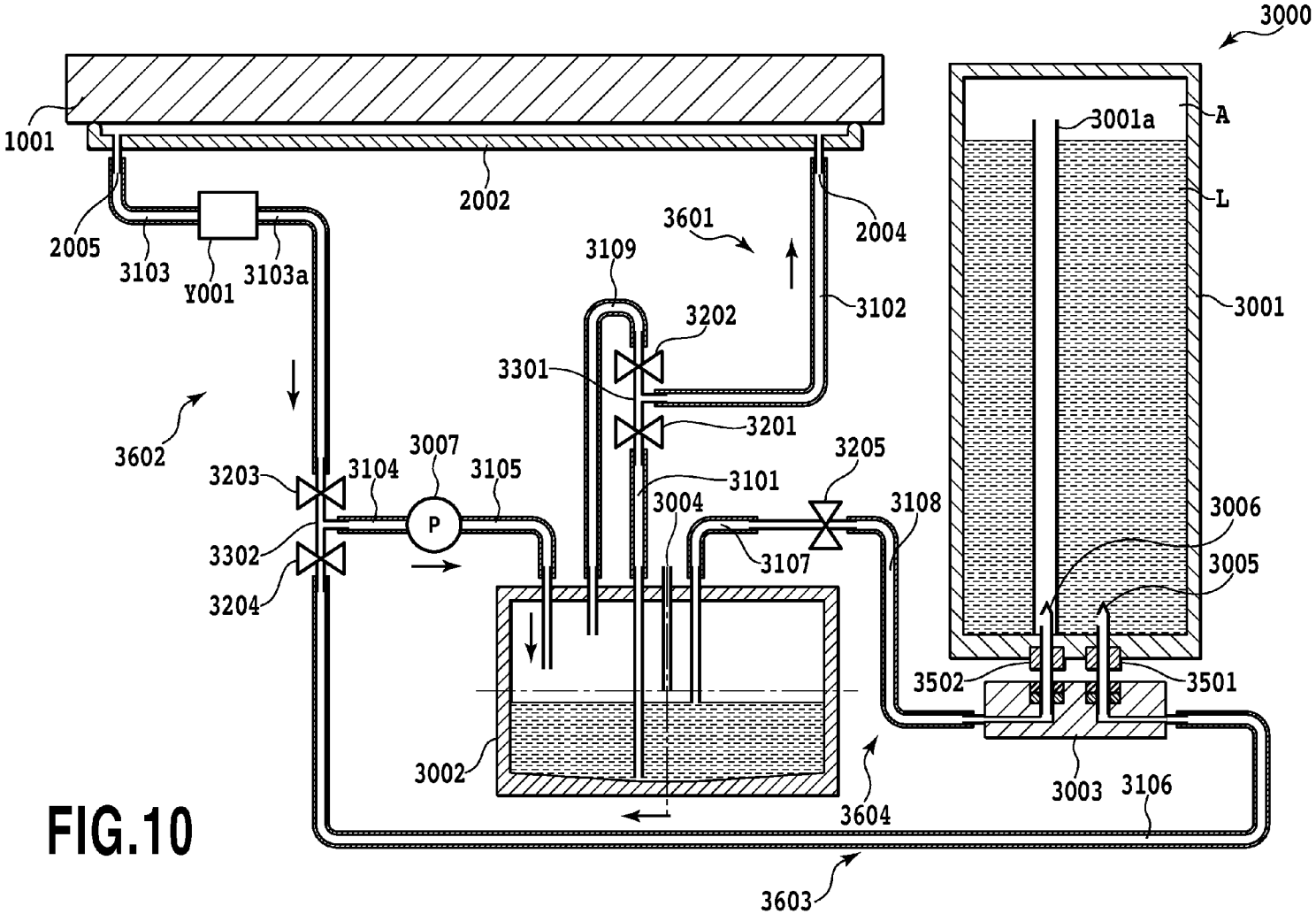
FIG. 10 is a diagram explaining an arrangement of liquid supplying means.

FIG. 10 is an explanatory diagram showing a schematic arrangement of a liquid flow passage 3000 of coating liquid supplying means for supplying the coating liquid to the liquid retaining member 2001.

The liquid flow passage 3000 includes a tube 3101 and a tube 3102 included in a first flow passage (supplying flow passage) 3601 connecting a liquid supplying opening 2009 of the coating cap 2002 constituting the liquid retaining member 2001 and a buffer tank 3002 for reserving the coating liquid. Further, the liquid flow passage 3000 includes a tube 3103, a liquid detecting sensor Y001, a tube 3103*a*, a tube 3104 and a tube 3105 included in a second flow passage (collecting flow passage) 3602. The second flow passage 3602 connects a liquid collecting opening 2005 of the coating cap 2002 and the buffer tank 3002. The buffer tank 3002 is provided with an atmosphere communicating opening 3004.

A first switching valve 3201 for switching communication and blockade of the flow passage of the coating liquid is arranged in a flow passage of a first branch flow passage 3301 at a side of the tube 3101 and a second switching valve 3202 is likewise arranged in the flow passage thereof at a side of a tube 3109. Further, one more connecting opening is connected to a flow passage from the first branch flow passage 3301 to be communicated through the tube 3102 with the liquid supplying opening 2004. In the arrangement of the first switching valve 3201, the second switching valve 3202 and the first branch flow passage 3301, the connection destination of the tube 3102 can be selected out of an atmosphere and the coating liquid reserved in the buffer tank 3002 by a combination of the communication and the blockade of the two switching valves.

Further, the tube 3103, the liquid detecting sensor Y001, the tube 3103*a*, the tube 3104, the tube 3105 and a pump 3007 are arranged in the second flow passage 3602. The pump 3007 forcibly flows the coating liquid and the air inside the flow passage 3000 toward the buffer tank 3002. The tube 3101 is connected to the flow passage connected to the pump 3007 at a side where the coating liquid enters into the pump 3007 (also called "upstream of the pump" in the present specification). On the other hand, the tube 3105 is connected to the flow passage connected to the pump 3007 at a side where the coating liquid flows out from the pump 3007 (also called "downstream of the pump" in the present specification). The tube 3105 establishes a connection between the buffer tank 3002 and the pump 3007.

By connecting the buffer tank 3002 and the coating cap 2002 with the first flow passage and the second flow passage and driving the pump 3007 in the flow passage, the coating liquid in the buffer tank 3002 is supplied into the coating cap 2002 to be re-circulated in these flow passages.

Further, the liquid flow passage 3000 includes an exchange tank 3001, and includes a third flow passage (refilling flow passage) 3603 connecting the exchangeable exchange tank 3001 for reserving the coating liquid to the second flow passage and a fourth flow passage 3609 connecting the buffer tank 3002 and the exchange tank 3001. It should be noted that the exchange tank 3001 is larger in volume than the buffer tank 3002.

A tube 3106 included in the third flow passage 3603 is connected to the exchange tank 3001 through an injection needle-shaped first connecting opening 3005 and a seat 3003 constituting a connection flow passage. That is, the injection needle-shaped first connecting opening 3005 penetrates through a rubber 3501 disposed in the bottom of the exchange tank 3001, and thereby the tube 3106 and the exchange tank 3001 are connected. The other end portion of the tube 3106 is connected to a second branch flow passage 3302. In the present embodiment, the tube 3106 acts as a refilling flow passage for supplying the coating liquid from the exchange tank 3001 to the buffer tank 3002.

The second branch flow passage 3302 is provided with a third switching valve 3203 at a connecting opening side with the tube 3103*a* from a merging point connecting three-direction openings for enabling the switching of communication and blockade between the tube 3103*a* and the second branch flow passage 3302. The second branch flow passage 3302 is provided with a fourth switching valve 3204 at a connecting opening side with the tube 3106 from the merging point for enabling the switching between communication and blockade of the tube 3106 and the second branch flow passage 3302. In the arrangement of the third switching valve 3203, the fourth switching valve 3204 and the second branch flow passage 3302, the connection destination to the tube 3104 can be selected out of the exchange tank 3001 and the coating cap 2002 by a combination of the communication and the blockade of the two switching valves.

The fourth flow passage 3604 includes tubes 3107 and 3108. The tube 3108 included in the fourth flow passage 3604 is connected to the exchange tank 3001 through an injection needle-shaped second connecting opening 3006 and a seat 3003 constituting a connection flow passage. That is, the injection needle-shaped second connecting opening 3006 penetrates through a rubber 3502 disposed in the bottom of the exchange tank 3001, and thereby the tube 3108 and the exchange tank 3001 are connected. The exchange tank 3001 is communicated with the buffer tank 3002 through a fifth switching valve 3205 which enables the switching between communication and blockade of the tubes 3107 and 3108.

An atmosphere communicating pipe 3001*a* is disposed in the exchange tank 3001. The atmosphere communicating pipe 3001*a* has a lower end connected to the second connecting opening 3006 and an upper end projecting into an air layer A in the exchange tank 3001. In this arrangement, by opening the fifth switching valve 3205, the internal pressure in the exchange tank 3001 can be balanced to an atmospheric pressure without the coating liquid L in the exchange tank 3001 flowing out into the recirculation passage.

When the fourth flow passage 3609 is disposed, it is not required to provide the atmosphere communicating opening in the exchange tank 3001. In addition, the fourth flow passage 3604 can be provided to perform recirculation supply at the time of supplying the coating liquid from the exchange tank 3001 to the buffer tank 3002. In a case where the coating liquid is left in the buffer tank 3002 at the time of supplying the coating liquid to the buffer tank 3002, there are some cases where viscosity of the left coating liquid is increased due to vaporization or the like. However, according to the present embodiment, the coating liquid supplied to the buffer tank 3002 and the left coating liquid are dissolved with each other, and further, the mutually dissolved coating liquid is fed to the exchange tank 3001. Therefore, the coating liquid in the buffer tank can be re-circulated inside the flow passage to reduce an influence of the vaporization in the buffer tank on the coating liquid. In addition, in the present embodiment, since the connecting opening to the exchange tank 3001 is formed in an injection needle shape and the bottom of the exchange tank 3001 is sealed by a rubber, the vaporization of the coating liquid in the exchange tank at the time the exchange tank is not mounted can be restricted.

It should be noted that, as shown in a block diagram of FIG. 2, the switching of each switching valve is performed by a control signal from the control unit 5000 as described later to perform the filling, supplying and collecting of the coating liquid. A detail of specific operations thereof will be described later.

In the present embodiment, the flow passage is formed in such a manner that the collection flow passage and the refilling flow passage merge at the upstream side of the pump 3007. In addition, the switching valve is arranged in each of the flow passage of the second branch flow passage 3302 at the side of the coating cap 2002 and the flow passage thereof at the side of the exchange tank 3001, and thereby opening/closing of the flow passage into the buffer tank 3002 and the flow passage between the collection flow passage and the refilling flow passage is switched. In a case where the collection flow passage and the flow passage where the pump 3007 is arranged are connected by switching the opening/closing of the switching valve, the fourth switching valve 3204 is closed in such a manner that the refilling flow passage and the pump 3007 are not connected. In consequence, the coating liquid can be re-circulated by driving the pump 3007 to perform supply of the coating liquid to and collection of the coating liquid from the liquid retaining space S. Further, in a case where the refilling flow passage from the exchange tank 3001 and the flow passage where the pump 3007 is arranged are connected to be communicated with each other by switching the opening/closing of the switching valve, the third switching valve 3203 between the collection flow passage from the coating cap 2002 and the flow passage where the pump 3007 is arranged is closed. In consequence, the coating liquid can be refilled through the third flow passage 3603 from the exchange tank 3001 to the buffer tank 3002.

In this way, in the present embodiment, the merging of the flow passage between the collection flow passage from the coating cap 2002 to the buffer tank 3002 and the refilling flow passage from the exchange tank 3001 to the buffer tank 3002 and the switching of these flow passages are performed upstream side of the pump 3007. The flow of the coating liquid in the flow passage not communicating with the flow passage where the pump 3007 is arranged is blocked by closing the valve. Accordingly, by controlling a route of the flow passage provided with the coating cap 2002, the buffer tank 3002 and the exchange tank 3001, it is possible to perform recirculation, collection and refilling of the coating liquid by using one pump alone. That is, even if the buffer tank and the exchange tank are simultaneously arranged in the same apparatus, it is not necessary to increase the number of the pump in use. Accordingly, it is not required to increase components in the flow passage and the control unit due to an increase in number of the pump, and an increase in the component number including the pump can be restricted. Therefore, an increase in size of the apparatus is prevented. Further, cost reduction on manufacture of the apparatus can be made.

(Liquid Application Operation Sequence)

Figure 11:
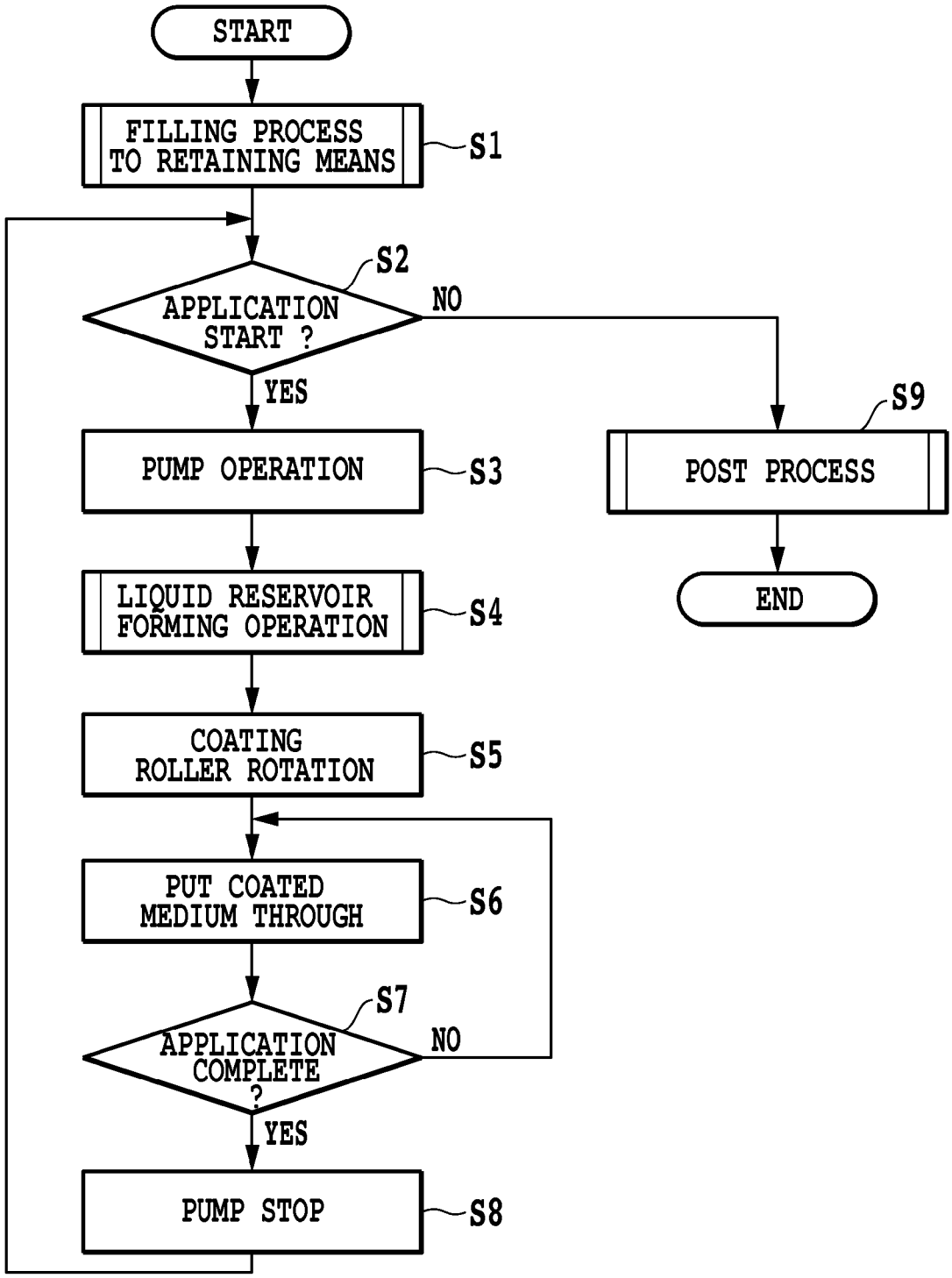
FIG. 11 is a flow chart showing sequence of a liquid application operation.

FIG. 11 is a flow chart showing the procedure in regard to the liquid application of the liquid application apparatus in the present embodiment. Hereinafter, each process of the liquid application will be explained with reference to this flow chart. That is, when power is inputted to the liquid application apparatus, the control unit 5000 executes the following application operation sequence according to the flow chart shown in FIG. 11.

When the application operation is started, first, a coating liquid is filled in the liquid retaining space S in the coating cap 2002 as the retaining means of the coating liquid (step S1). When a sufficient amount of the coating liquid is filled in the liquid retaining space S in the coating cap 2002, the application process is started. In addition, when an application start command is inputted (step S2), the pump 3007 starts to operate (step S3), and subsequently an operation of forming a liquid reservoir, which will be described later, is performed (step S4). The removal operation of the solidified coating liquid and the lubricant refilling operation to the contacting portion will be described later. Thereafter, the coating roller 1001 starts to rotate in a direction of applying the coating liquid on the coated medium P (step S5). With rotation of the coating roller 1001, the coating liquid L filled in the liquid retaining space S passes through between the coating roller 1001 and the lower edge portion 2011 of the contacting member 2007 against the pressing force of the contacting member 2007 in the liquid retaining member 2001 to the coating roller 1001. The passed coating liquid attaches on the outer periphery of the coating roller 1001 in a layered state. The coating liquid L attached on the coating roller 1001 is sent to the contacting portion between the coating roller 1001 and the counter roller 1002.

Figure 12A:
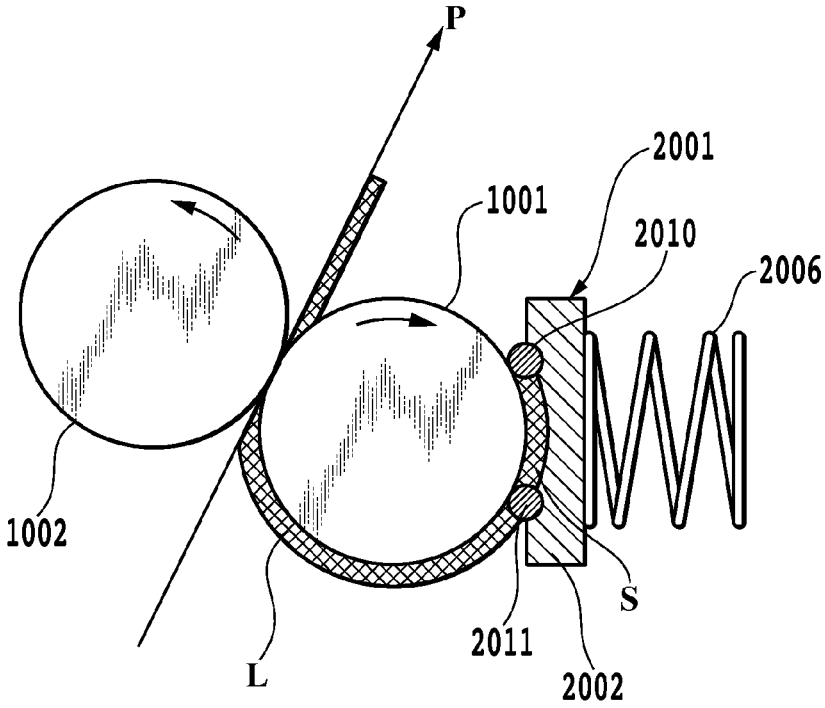
FIG. 12A and FIG. 12B are cross sections each diagrammatically showing a state where the liquid is applied on a coated medium.

Next, the coated medium is conveyed between the coating roller 1001 and the counter roller 1002 by the coated medium supplying mechanism 1006 and the coated medium is inserted between the rollers. Along with it, the coated medium is conveyed toward the discharge unit as a result of the rotation of the coating roller 1001 and the counter roller 1002 (step S6). The coating liquid applied on the outer peripheral surface of the coating roller 1001 transfers from the coating roller 1001 to the coated medium P during the conveying as shown in FIG. 12A. The means for supplying the coated medium P between the coating roller 1001 and the counter roller 1002 is not limited to the above supplying mechanism. As such means, for example, manual means secondarily using a given guide member may be used together. Further, the other means such as an arrangement of using the manual means independently may be used.

In FIG. 12A, the coating liquid L is shown in a portion expressed in intersecting hatched lines. Here, a thickness of a layer of the coating liquid on the coating roller 1001 and on the coated medium P is expressed much more excessively than an actual thickness thereof and is diagrammatically shown for explaining a state of the coating liquid L at applying. As described above, the applied portion of the coated medium P is conveyed in an arrow direction by the conveying force of the coating roller 1001. Along with it, a portion of the coated medium P which is not applied is conveyed to a contacting portion between the coated medium P and the coating roller 1001, and the coating liquid is gradually applied over an entirety of the coated medium by performing this operation sequentially or intermittently. FIG. 12A shows an ideal application state in which all of the coating liquids L which pass through the lower edge portion 2011 of the contacting member 2007 and are attached on the coating roller 1001 transfer on the coated medium P. However, actually not all of the coating liquids L attached on the coating roller 1001 transfer on the coated medium P. That is, when the coated medium P to be conveyed leaves away from the coating roller 1001, the coating liquid L is also attached on the coating roller 1001. Therefore, there are some cases where the coating liquid L remains on the coating roller 1001. A remaining amount of the coating liquid L on the coating roller 1001 is different depending on a material quality of the coated medium P and a state of fine concave and convex portions on a surface thereof, and in a case where the coated medium P is a plain paper, the coating liquid L remains on the peripheral surface of the coating roller 1001 after the application operation. The coating liquid remaining on the coating roller 1001 passes through between the coating roller 1001 and the upper edge portion 2010 of the contacting member 2007 against the pressing force of the contacting member 2007 in the liquid retaining member 2001 to the coating roller 1001 and returns back into the liquid retaining space S. The coating liquid returned back into the liquid retaining space S is mixed with the coating liquid filled in the liquid retaining space S.

Figure 12B:
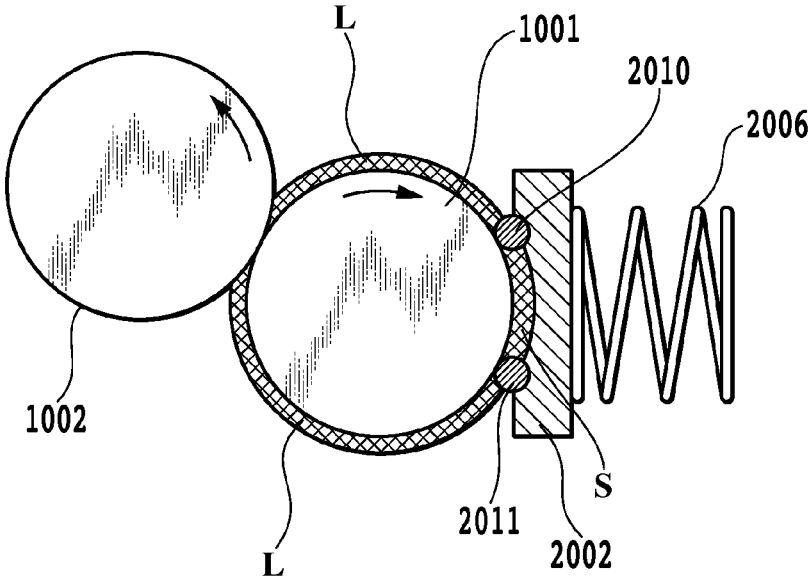

The returning operation of the coating liquid to the liquid retaining space S is likewise performed also in a case of rotating the coating roller 1001 in a state where the coating liquid does not exist as shown in FIG. 12B. That is, the coating liquid attached on the outer periphery of the coating roller 1001 by rotating the coating roller 1001 passes through between contacting portions of the coating roller 1001 and the counter roller 1002. After the passing, the coating liquid is separated into the side of the coating roller 1001 and the side of the counter roller 1002, and the coating liquid remains on the coating roller 1001. The coating liquid L attached on the side of the coating roller 1001 passes through between the coating roller 1001 and the upper edge portion 2010 of the contacting member 2007 and enters into the liquid retaining space S to be mixed with the coating liquid filled in the liquid retaining space S.

When the application operation to the coated medium is performed as described above, in the flow chart shown in FIG. 11 it is determined whether or not the application process should be terminated (step S7). In a case where the application process is not terminated, the process goes back to step S5 and the application operation is repeated until the application process is completed in an entire portion of the coated medium in which the application is required. When the application process is completed, the drive of the pump 3007 is stopped (step S8). Thereafter, the process goes to step S2 and when the application start command is inputted, the operations from step S2 to step S8 are repeated. On the other hand, when the application start command is not inputted, a post-processing such as a collecting operation for collecting the coating liquid in the liquid retaining space S and the liquid flow passage is executed (step S9) and the process for the application ends.

(Liquid Reservoir Forming Operation)

Figure 13A:
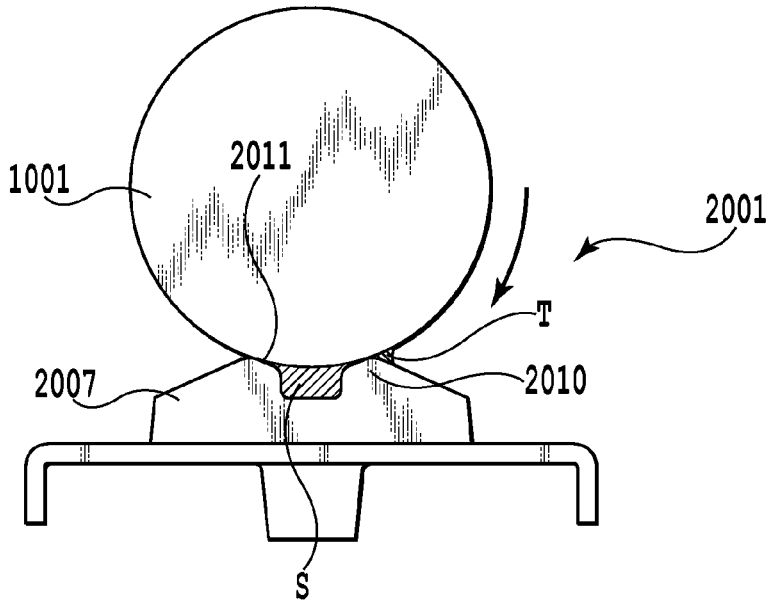
FIG. 13A and FIG. 13B are cross sections each diagrammatically showing a contacting portion between the coating roller and a contacting member.

Upon returning the coating liquid back to the liquid retaining space S, the majority of the coating liquids pass through between the upper edge portion 2010 of the contacting member 2007 and the coating roller 1001, but some of the coating liquids are taken out by the upper edge portion 2010 of the contacting member 2007. That is, as shown in FIG. 13A, there exist the coating liquids remaining between the coating roller 1001 and the upper edge portion 2010 of the contacting member 2007, between the coating roller 1001 and the lower edge portion 2011 thereof, and in the periphery thereof. There are some cases where the remaining coating liquids become a mass of droplets by surface tension. When the remaining coating liquid is left as it is for long hours in this state, water components in the remaining coating liquid vaporize to increase a viscosity of the coating liquid left on the coating roller 1001. In addition, when the coating roller 1001 continues to be further left as it is, only involatile components in the coating liquid remain in the contacting portion between the coating roller 1001 and the contacting member 2007 to be solidified, possibly producing a phenomenon that the coating roller 1001 and the contacting member 2007 bond together.

Figure 13B:
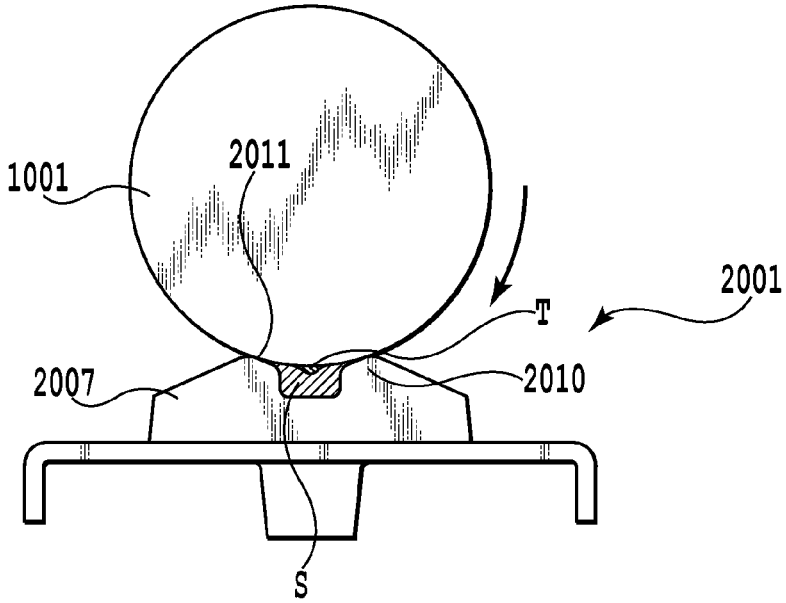

Assuming that the coating liquid is applied on the coated medium P as it is by the conventional application mechanism, the following phenomenon is estimated to take place. That is, at an initial operation time of the coating roller 1001 after it is left for long hours, the coating liquid between the coating roller 1001 and the contacting member 2007 is solidified. The coating roller 1001 and the contacting member 2007 bond together through the solidified coating liquid. When the coating roller 1001 starts to rotate from that state, the coating liquid bonded at the contacting portion between the coating roller 1001 and the contacting member 2007 is peeled off from the coating roller 1001 by rotation of the coating roller 1001. The coating roller 1001 rotates while dragging the solidified coating liquid. The solidified coating liquid enters into the contacting portion between the coating roller 1001 and the contacting member 2007 as a result of the rotation of the coating roller 1001 and enters into the inside of the liquid retaining space S as shown in FIG. 13B. At this time, an abnormal noise possibly occurs from the contacting portion between the coating roller 1001 and the contacting member 2007. In addition, a leak occurs in the contacting portion between the coating roller 1001 and the contacting member 2007, possibly creating occurrence of a liquid leakage from there. Further, when the application operation is performed in a state where the coating liquid increases in viscosity or is solidified, a distance from the rotational axis of the coating roller 1001 to an application face of the peripheral surface thereof becomes uneven, thereby creating a possibility that a uniform layer of the coating liquid can not be formed thereon. Such cause produces a possibility that an application amount of the coating liquid applied on the coated medium P becomes uneven.

In contrast, according to the present embodiment, the upper edge portion 2010 in the upstream side in the conveying direction of the coated medium (downstream side in the reverse rotational direction of the coating roller 1001) in the liquid retaining member is separated from the coating roller 1001 once before performing the application operation, and the reverse rotational operation of the coating roller 1001 is performed in this state. Here, the direction in which the coated medium is conveyed (direction in which the coating roller 1001 rotates in a clockwise direction in FIG. 14A) is assumed to be called a forward rotational direction (first direction). In addition, a direction of the coating roller 1001 rotating in the reverse direction to the forward rotational direction is assumed to be called a reverse rotational direction (second direction). At this time, the coating roller 1001 rotates in a reverse direction to a direction of conveying the coated medium P in a state where the coating roller 1001 is separated from a downstream portion of the contacting member 2007 in the reverse rotational direction. Hereby the coating liquid is supplied from the liquid retaining space S to the upstream side of the coating roller 1001.

Thereafter, the application mechanism moves to the application operation and the coating roller 1001 rotates in the forward rotational direction. At this time, the contacting member 2007 of which the downstream portion in the reverse rotational direction has been separated from the coating roller 1001 goes back to the position before the separation to be in contact with the coating roller 1001, thus performing sealing between them. Since the coating roller 1001 rotates in the forward rotational direction in this state, the coating liquid attached on the peripheral surface of the coating roller 1001 is blocked at the contacting portion, forming a liquid reservoir by the coating liquid in the lower edge portion of the sealing portion of the liquid retaining member. As a result, since the coating liquid forming the liquid reservoir acts as a lubricant upon applying the coating liquid on the coated medium P, a friction between the coating roller 1001 and the contacting member 2007 can be reduced. In addition, the coating liquid solidified on the peripheral surface of the coating roller 1001 results in entering into the inside of the liquid reservoir once before passing between the coating roller 1001 and the contacting member 2007. Accordingly, it is possible to dissolve the solidified coating liquid into the coating liquid reserved as the liquid reservoir. Therefore, since the coating liquid solidified on the peripheral surface of the coating roller 1001 is dissolved to become smaller after the solidified coating liquid passes between the coating roller 1001 and the contacting member 2007, the peripheral surface of the coating roller 1001 is made in a more smooth state and an application of the coating liquid is performed thereon. In consequence, occurrence of the abnormal noise or the liquid leakage from the application mechanism is restricted at the time of performing the application operation and the application amount of the coating liquid on the coated medium P becomes more uniform. In this way, the application mechanism is controlled in such a manner as to once put the peripheral surface of the coating roller 1001 having a possibility of drying out due to the attached coating liquid increasing in viscosity, through the liquid reservoir formed by the coating liquid.

Figure 14A:
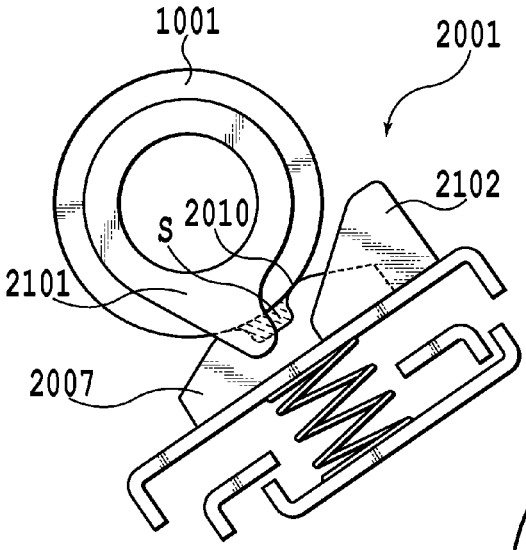
FIG. 14A to FIG. 14C are cross sections each diagrammatically showing the contacting portion between the coating roller and the contacting member.

Hereinafter, the liquid reservoir forming process and the process in which the coating roller 1001 passes through the liquid reservoir formed in the liquid reservoir process will be in detail explained. When an application start command is inputted (step S2 in liquid application operation sequence shown in FIG. 11), the pump 3007 starts to operate (step S3). FIG. 14A is a diagrammatical cross section showing the application mechanism in a preparation state in regard to the application operation before the application in the present embodiment. At this stage, the liquid retaining space S is filled with the coating liquid and the coating roller 1001 is being stopped. When the application mechanism is left as it is for long hours, the coating liquid left outside of the liquid retaining space S on the peripheral surface of the coating roller 1001 exists on the peripheral surface of the coating roller 1001 in a state of being increased in viscosity and solidified (hereinafter, refer to solidified coating liquid T).

Assuming that the application operation is performed by rotating the coating roller 1001 in the forward rotational direction at this condition, at this time the solidified coating liquid T enters into a portion between the coating roller 1001 and the contacting member 2007 as a result of the rotation of the coating roller 1001. Then, there arises a problem that an abnormal noise occurs from the application mechanism or an application amount of the coating liquid on the coated medium P from the application mechanism becomes uneven.

For beforehand solving this problem, the application mechanism in the present embodiment is provided with a mechanism for controlling at least a part of the contacting member 2007 to contact against and separate from the coating roller 1001. The present embodiment is provided with the mechanism for controlling the downstream portion of the contacting member 2007 in the reverse rotational direction to contact against and separate from the coating roller 1001. The mechanism includes a separate cam 2101 provided to be coaxial with the rotational axis of the coating roller 1001 and a cam follower 2102 provided at the same position reference with the contacting member 2007 on the coating cap. A one-way clutch is mounted in a rotational axis of the separate cam 2101. When the coating roller 1001 rotates in a forward rotational direction, the separate cam 2101 runs idle to the cam follower 2102, and when the coating roller 1001 rotates in the reverse rotational direction, the separate cam 2101 rotates in association with the coating roller 1001 through the one-way clutch. That is, when the coating roller 1001 rotates in the forward rotational direction, the separate cam 2101 runs idle to the rotation of the coating roller 1001, and when the coating roller 1001 rotates in the reverse rotational direction, the separate cam 2101 rotates with the coating roller 1001. Only at the reverse rotational operation, the separate cam 2101 rotates and in a position of contacting with the cam follower 2102, the cam follower 2102 is pushed by the separate cam 2101 and the contacting member 2007 is configured to displace in response to a position of the separate cam 2101.

In the preparation state in regard to the application operation before the application shown in FIG. 14A, the separate cam 2101 is urged to a position of not contacting with the cam follower 2102 as shown in the figure by an urging spring and a stopper which are not shown (initial position).

Figure 14B:
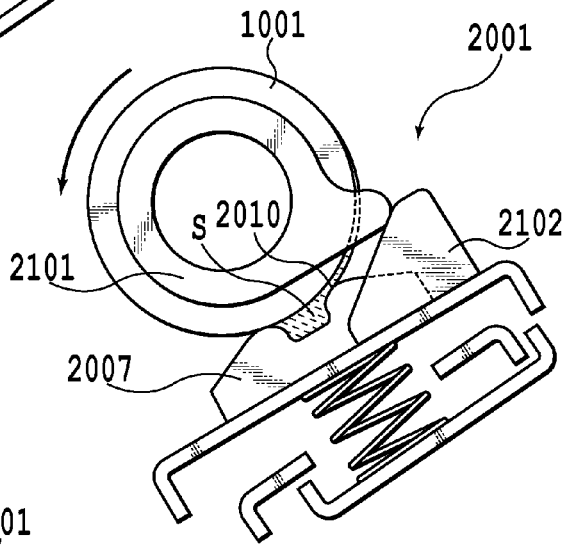

Subsequently the process goes to the application operation. Here, at step S4 in the flow chart of the liquid application operation sequence shown in FIG. 11, the liquid reservoir forming operation is performed. That is, the coating roller 1001 once performs a rotational operation in a reverse direction to a direction of performing sheet conveying of the coated medium P (an arrow direction in FIG. 14B: counterclockwise direction). In addition, by rotation of the separate cam 2101 in association with the rotational operation, the cam follower 2102 on the coating cap is pressed to move the contacting member 2007 to an outer side from the rotational axis of the coating roller 1001 as shown in FIG. 14B. In this state, a part of the contacting member 2007 (upper edge portion 2010 as a part of the contacting member 2007 at the downstream side in the reverse rotational direction) is separated slightly from the coating roller 1001 and the liquid retaining space S is opened. It should be noted that an entire peripheral surface of the contacting member 2007 may be separated slightly from the coating roller 1001. That is, in a state where at least the part of the contacting member 2007 is separated from the coating roller 1001 to form a clearance therebetween, the application mechanism performs the reverse rotational operation of the coating roller 1001. Thereby, as shown in FIG. 14B, a relatively large amount of the coating liquids are pulled out through the clearance from the inside of the liquid retaining space S along the surface of the coating roller 1001.

In this way, the method of controlling the application mechanism in the present embodiment has the reverse rotational process in which the liquid retaining member 2001 is separated from the coating roller 1001 and the coating roller 1001 is rotated in a reverse direction to the conveying direction of the coated medium P to pull the coating liquid from the liquid retaining space S onto the coating roller 1001. The application mechanism in the present embodiment separates the downstream portion of the liquid retaining member 2001 in the reverse rotational direction away from the coating roller 1001 to rotate the coating roller 1001 in a second direction as a reverse direction to the conveying direction of the coated medium P as the first direction. Further, the coating liquid is pulled out from the liquid retaining space S onto the coating roller 1001.

The application mechanism in the present embodiment includes the separate cam 2101 provided coaxially with the coating roller 1001 for separating the liquid retaining member 2001 from the coating roller 1001 when the coating roller 1001 rotates in the reverse rotational direction as described above. In addition, the application mechanism in the present embodiment includes the cam follower 2102 provided in the liquid retaining member 2001. In the present embodiment, in a state where the separate cam 2101 and the cam follower 2102 move together to separate the coating roller 1001 from the liquid retaining member 2001, the liquid reservoir forming process is executed. That is, in the present embodiment, the separate cam 2101 and the cam follower 2102 act as a mechanism which controls the liquid retaining member 2001 to contact against and separate from the coating roller 1001. That is, the liquid reservoir forming process in the present embodiment is executed by the control of the coating roller 1001 by the control unit including the CPU 5001 and the associated operation of the separate cam 2101 and the cam follower 2102.

In this way, according to the method of controlling the application mechanism in the present embodiment, the coating roller 1001 is rotated in a forward rotational direction after the reverse rotational process is executed. Further, the method of controlling the application mechanism in the present embodiment includes the liquid reservoir forming process of forming the liquid reservoir by reserving the coating liquid pulled out at the reverse rotational process in the periphery of the contacting portion between coating roller 1001 and the liquid retaining member 2001.

At this time, as described above, the application mechanism in the present embodiment is structured in such a manner that the liquid retaining member 2001 rotates substantially around the outer peripheral portion of the coating roller 1001 as a rotational center to displace the liquid retaining member 2001 within an extremely small range to the a rotational center of the coating roller 1001. The separate cam 2101 is provided to be coaxial with the coating roller 1001, and the cam follower 2102 is provided on the coating cap 2002 as a component of the liquid retaining member 2001. Based upon the above arrangement, fine position adjustment of the liquid retaining member 2001 is possible, and therefore a separate amount in the upper edge portion 2010 of the liquid retaining member 2001 from the coating roller 1001 and a contacting position between the coating roller 1001 and the liquid retaining member 2001 at the time the liquid retaining space S are sealed can be accurately determined. Therefore, when the coating roller 1001 rotates in the reverse direction, an amount of the coating liquid attached to the coating roller 1001 and pulled out to the reverse rotating direction once can be adjusted.

Figure 14C:
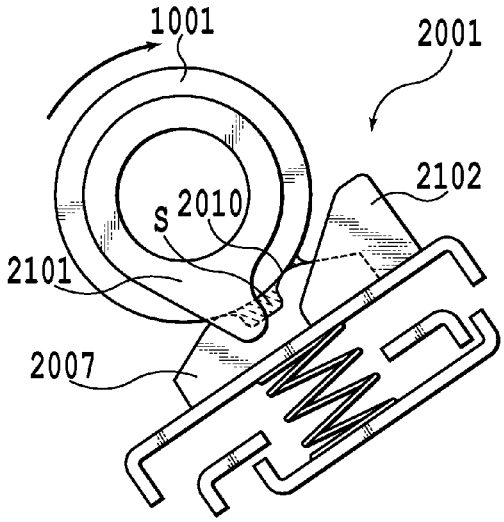

After the reverse rotational operation is performed, the coating roller 1001 moves to the application operation by performing the forward rotational operation in the same direction as a direction of performing a usual conveying of the coated medium P (arrow direction in FIG. 14C: clockwise direction). In a case where the coating roller 1001 rotates in a direction of performing the forward rotational operation, the separate cam 2101 runs idle and the contacting member 2007 is returned back to an initial position by the urging spring (not shown) and the stopper (not shown). In the halfway of the operation, the separate cam 2101 slides down on a slant surface of the cam follower 2102 to release the pressing force to the contacting member 2007 and the upper edge portion 2010 of the contacting member 2007 once again contacts against the peripheral surface of the coating roller 1001 to seal the liquid retaining space S.

By a series of the operations as result of the reverse rotational operation of the coating roller 1001 as described above, the coating liquid solidified on the surface of the peripheral surface of the coating roller 1001 is once pulled in a reverse direction to a direction of conveying the coated medium P. Along with it, the coating liquid in the liquid retaining space S is once conveyed in the reverse direction. Then, by performing the forward rotational operation of the coating roller 1001 after that, the solidified coating liquid and the coating liquid of the liquid attached on the coating roller 1001 are carried toward the liquid retaining space S. Since the separate cam 2101 and the cam follower 2102 are disengaged at this time, the contacting member 2007 is positioned in a portion contacting with the coating roller 1001 to seal the liquid retaining space S. Therefore, in a state where the sealing is made between the contacting member 2007 and the upper edge portion 2010, the coating liquid once pulled from the liquid retaining space S will be returned back to the liquid retaining space S by the forward rotation of the coating roller 1001. Here, since the sealing is made between the contacting member 2007 and the upper edge portion 2010, the coating liquid which is once pulled from and will be back to the liquid retaining space S is blocked with the upper edge portion 2010 between the coating roller 1001 and the contacting member 2007. Apart of the blocked coating liquid is collected in the liquid retaining space S and the rest thereof remains outside of the upper edge portion 2010 as the liquid reservoir. In this way, the liquid reservoir is formed in the upper edge portion 2010. In the present embodiment, the control unit including the CPU 5001 controls the rotational drive including the forward rotation and the reverser rotation of the coating roller 1001 to execute the liquid reservoir forming process.

Therefore, at the forward rotation time of the coating roller 1001, the peripheral surface of the coating roller 1001 passes through the liquid reservoir formed at this time and the contacting portion with the contacting member 2007. In consequence, since the solidified coating liquid T existing on the surface of the coating roller 1001 and in the periphery of the contacting portion of the liquid retaining member is dissolved by the coating liquid forming the liquid reservoir, the surface of the coating roller 1001 can be smooth to reduce the friction between the coating roller 1001 and the contacting member 2007. As a result, occurrence of the abnormal noise between the coating roller 1001 and the contacting member 2007 and the liquid leakage can be restricted. In addition, the coating liquid attached and solidified on the peripheral surface of the coating roller 1001 for dissolving at this time is not only the solidified coating liquid T existing in the periphery of the contacting portion of the liquid retaining member but also an entirety of the coating liquid attached and solidified on an entire peripheral surface of the coating roller 1001. Therefore, as the coating liquid forming the liquid reservoir at this time, a sufficient amount of the coating liquids to the extent that even when the coating roller 1001 makes a round, the liquid reservoir still exists is required.

In addition, since the coating liquid forming the liquid reservoir acts as a lubricant even if the peripheral surface of the coating roller 1001 dries out at a restart time of the application mechanism, the friction between the coating roller 1001 and the contacting member 2007 can be reduced. Therefore, the wear of the coating roller 1001 is reduced to improve the durability of the application mechanism. In this way, the application mechanism is controlled in such a manner that the peripheral surface of the coating roller 1001 abuts to the coating liquid forming the liquid reservoir.

In consideration of only a measure against sliding noises due to the friction generated at an initial operation time of the coating roller 1001 after it is left for long hours, an amount of the liquid reservoir may be a relatively small. That is, the liquid reservoir is only required to exist until the solidified portion of the coating liquid on the coating roller 1001 in the vicinity of the lower edge portion 2011 of the contacting member 2007 makes a round and enters into the upper edge portion 2010 of the contacting member 2007. In the present embodiment, an amount of the coating liquid forming the liquid reservoir may be about 0.1 g as a whole along a width direction in the upper edge portion 2010 of the contacting member 2007. In the present embodiment, when a separate amount of the upper edge portion 2010 in contacting member 2007 from the coating roller 1001 is set as about 0.1 mm and a reverse rotational amount of the coating roller 1001 is set as about 90 degrees, the liquid reservoir having the above-mentioned amount can be formed.

However, a degree of an increase in viscosity or solidification of the solidified coating liquid T is different depending on a time while the mechanism is left as it is from the previous application operation since water component vaporization of the coating liquid is the cause of it. That is, as the time while the mechanism is left as it is gets the longer, the degree of the increase in viscosity/the solidification is facilitated. That is, in a case where the time while the mechanism is left as it is from the previous application operation is short in the aforementioned removal operation of the solidified coating liquid, the positioning of the contacting member 2007 or the separate amount between the coating roller 1001 and the contacting member 2007 may be set to form the aforementioned liquid reservoir amount. On the other hand, in a case where the time while the mechanism is left is long, a large amount of the dissolution time and a great amount of the coating liquids are required for dissolving the solidified coating liquid T. Therefore, in the present embodiment, the control unit is programmed to increase the reverse rotational amount of the coating roller 1001 in response to the time while the mechanism is left as it is to increase an amount of the coating liquid forming the liquid reservoir.

It should be noted that a dissolution amount of the coating liquid solidified in accordance with a time while the mechanism is left as it is may be controlled by adjusting a speed or a rotational amount of the rotational operation of the coating roller 1001 at the time of passing through the liquid reservoir without changing an amount of the liquid reservoir at the time of reversely rotating the coating roller 1001, which is set as about 0.1 g as described above. In a case where the time while the mechanism is left is relatively short, it is possible to shorten the removal operation of the solidified coating liquid by speeding up a rotational speed of the coating roller 1001 or reducing a rotational amount thereof. In addition, in a case where the time while the mechanism is left is long, the removal of the solidified coating liquid suitable for the time while the mechanism is left is possible by performing the rotational operation for an appropriate time in accordance with the time while the mechanism is left as it is.

In the application mechanism of the present embodiment, Table 1 shows a specific example of a rotational speed and a rotational amount of the coating roller in accordance with a time while the mechanism is left.

TABLE 1

| Time while the mechanism is left | |
|---|---|
| From 55 sec to less than 15 min | one rotation with 2.0 inch/sec + one rotation with 3.3 inch/sec |
| From 15 min to less than 3 h | one rotation with 2.0 inch/sec + one rotation with 3.3 inch/sec |
| From 3 h to less than 60 h | one rotation with 2.0 inch/sec + one rotation with 3.3 inch/sec + one rotation with 5.3 inch/sec |
| From 60 h to less than 172 h | one rotation with 0.8 inch/sec + four rotations with 3.3 inch/sec + one rotation with 5.3 inch/sec |
| 172 h or more | one rotation with 0.8 inch/sec + four rotations with 2.0 inch/sec + one rotation with 5.3 inch/sec |

In this way, the application mechanism in the present embodiment includes time information obtaining means for obtaining information regarding time at the previous drive time, wherein the time information obtaining means is used at the removal operation time of the solidified coating liquid to calculate an elapse time from a time at the previous application. In addition, by selecting an operational condition of the application mechanism in accordance with the calculated elapse time, it is possible to efficiently perform the removal operation of the solidified coating liquid in accordance with the elapse time.

Until this, the process from the previous application operation to the removal operation of the solidified coating liquid after the mechanism is left is described and the liquid reservoir forming process also has an effect in reduction of the biased wear of the coating roller 1001 as shown in the following.

In a state after the usual application operation is performed, the coating liquid attached on the coating roller 1001 in a portion within the width of the coated medium in the width direction of the coating roller 1001 transfers to the coated medium. Therefore, the peripheral surface of the coating roller 1001 corresponding to the transferred portion is in a dried-out state. Accordingly in this portion, the coating roller 1001 is to be in contact with the contacting member 2007 in the dried-out state. On the other hand, when the width of the coated medium is small, there are some cases where the application of the coating liquid is not performed in a portion outside of the width of the coated medium. Since the transfer of the coating liquid to the coated medium is not performed, the coating liquid attached on the coating roller 1001 remains as attached on the peripheral surface of the coating roller 1001. As a result, in this portion, the coating roller 1001 is to be in contact with the contacting member 2007 in a wet state. Therefore, in a state where the friction is relatively small on the coating roller 1001 in an area outside of the width of the coated medium and the friction is relatively large on the coating roller 1001 in an area inside of the width of the coated medium, the coating roller 1001 and the contacting member 2007 are contacted with each other. In this way, when the coating roller 1001 gets in contact with the contacting member 2007, a difference in friction on the coating roller 1001 occurs in the width direction of the coated medium to produce the biased wear in the coating roller 1001. In the application arrangement of the present embodiment, when a difference in an outer diameter of the coating roller 1001 around the rotational axis due to the biased wear thereof is 150 μm or more, an application amount of the coating liquid in the width direction of the coated medium becomes irregular.

The arrangement of the application mechanism in the present embodiment is effective also in a reduction of such biased wear of coating roller 1001. That is, by performing the aforementioned removal operation of the solidified coating liquid before the liquid application operation, the liquid reservoir by the coating liquid is formed over an entirety of the upper edge portion 2010 of the contacting member 2007 in the width direction.

Hereby even if the portion of the coating roller 1001 positioned inside of the coated medium in the width direction is in a dried-out state by performing a transferring of the coating liquid into the coated medium, the entirety of the peripheral surface of the coating roller 1001 in the width direction is to pass through the liquid reservoir. Accordingly the entirety of the peripheral surface of the coating roller 1001 will get in contact with the contacting member 2007 in a wet state to reduce the difference in magnitude of the friction on the coating roller 1001 in the width direction thereof. Therefore, the biased wear of the coating roller 1001 can be reduced at the time of applying the coating liquid on the coated medium.

Figure 15:
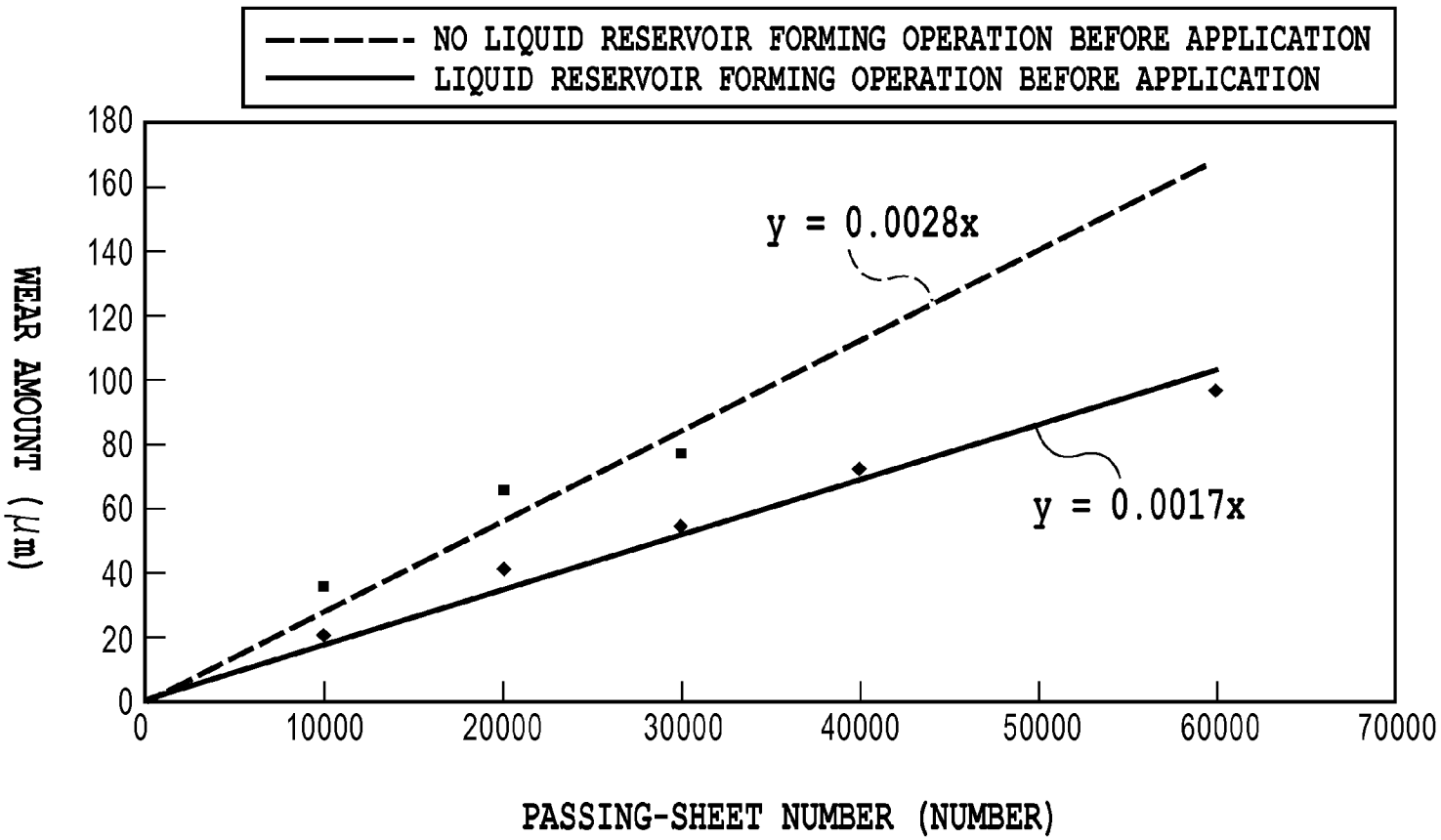
FIG. 15 is a graph showing a comparison of wear amounts of the coating roller.

FIG. 15 is a graph where a plurality of coated mediums each having a A4-size are coated by a coating roller in which a reverse rotational operation of a coated material is performed before an application operation as in the case of the present embodiment and a coating roller in which the process moves to a application operation without any reverse rotational operation and thereafter, a comparison in a biased wear amount between the coating rollers is made. A vertical axis of the graph in FIG. 15 shows a biased wear amount of the coating roller 1001 on each condition and a lateral axis thereof shows a coating sheet number (number of times of the application) to the coated medium. Here, in the biased wear amount of the vertical axis, since the coating roller 1001 outside of the coated medium substantially has almost no wear, the wear amount of the coated portion is used as the biased wear amount as it is. When the application mechanism continues to perform the application operation without performing any rotational operation before the application operation, a wear amount of about 150 μm is generated at the time the application operation is performed regarding 50000 sheet numbers, and irregularity of the application amount starts to be generated in the width direction. On the other hand, according to the present embodiment, even after the application operation to 60000 sheet numbers found by further adding 10000 to 50000 is performed, it is possible to restrict the wear amount to the order of 100 μm having a sufficient margin.

It should be noted that the liquid application to the A4-sized coated medium is explained, but the present invention may be applied to a coated medium having another size. In this case, a rotational amount in a reverse rotational operation of the coating roller 1001 before the application operation may be changed depending on a size of the coated medium or a separate amount between the coating roller 1001 and the liquid retaining member 2001 may be changed. With this way, an amount of the coating liquid forming the liquid reservoir can be controlled, and the reverse rotational operation of the coating roller 1001 can be performed in such a manner as to form the liquid reservoir having an amount of the coating liquid corresponding to the size of the coated medium. As a result, at the time of applying a coating liquid on a small-sized coated medium, an unnecessary large amount of the reverse rotational operation can be omitted and by shortening the reverse rotational operation, throughput of the application operation can be improved.

In the above present embodiment, the mechanism of controlling the contacting member 2007 to contact with and separate from the coating roller 1001 is configured by the separate cam 2101 and the cam follower 2102. The separate cam 2101 is arranged to be coaxial with the rotational axis of the coating roller 1001. The cam follower 2102 is provided on the coating cap in the same position reference with the contacting member 2007. Therefore, the liquid reservoir amount can be accurately formed with a simple arrangement. However, the application mechanism of the liquid in the present embodiment is not limited to the arrangement of the above embodiment and the application mechanism may be configured by a different arrangement. Hereinafter, an application mechanism of a liquid according to a different embodiment will be explained with reference to FIGS. 16A to 16C. The liquid application mechanism differs from the above embodiment in a point of providing a contacting-portion separating mechanism in a position different from the rotational axis of the coating roller 1001.

Figure 16A:
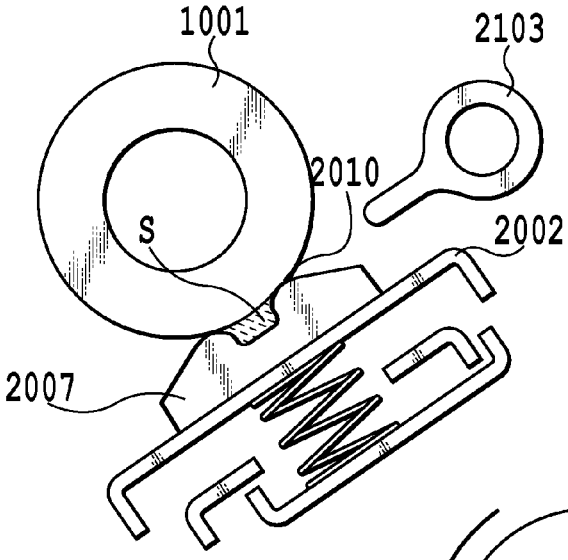
FIG. 16A to FIG. 16C are cross sections each explaining a liquid application in a different embodiment.

According to the present embodiment, as shown in FIG. 16A, a separate arm 2103 as a contacting-pressure releasing member is arranged above the upper edge portion 2010 of the contacting member 2007 in the gravity direction. FIG. 16A shows an application mechanism in a state of stopping before application, wherein the application mechanism is in a preparation state for the application operation. The liquid retaining space S is already filled with the coating liquid at this stage. The separate arm 2103 is, at the time the coating roller 1001 is in a stop or forward rotational state, in a position away from the coating cap 2002, and the upper edge portion 2010 of the contacting member 2007 and the coating roller 1001 are held in a contacting state.

Figure 16B:
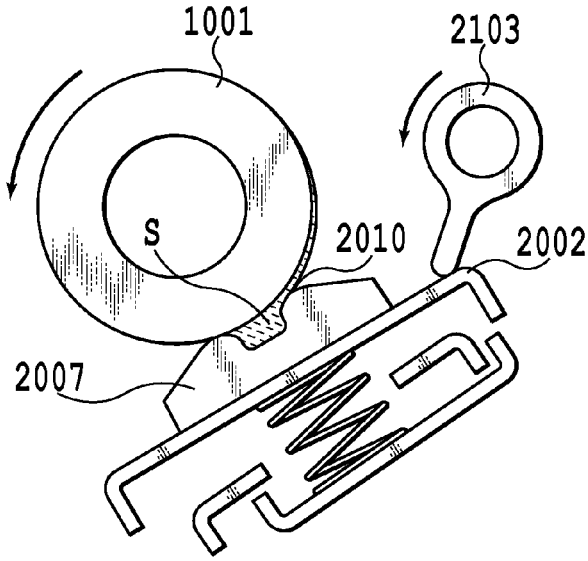

Next, when the application mechanism moves to the reverse rotational process, the coating roller 1001 once rotates reversely. At the reverse rotational time of the coating roller 1001, as shown in FIG. 16B, the separate arm 2103 rotates in association with the reverse rotational operation (counterclockwise direction shown in an arrow direction in FIG. 16B) of the coating roller 1001 to be in contact with the coating cap 2002. Therefore, the upper edge portion 2010 of the contacting member 2007 is pushed down in the gravity direction to be separated from the coating roller 1001, thus forming a slight clearance between the upper edge portion 2010 of the contacting member 2007 and the coating roller 1001.

Figure 16C:
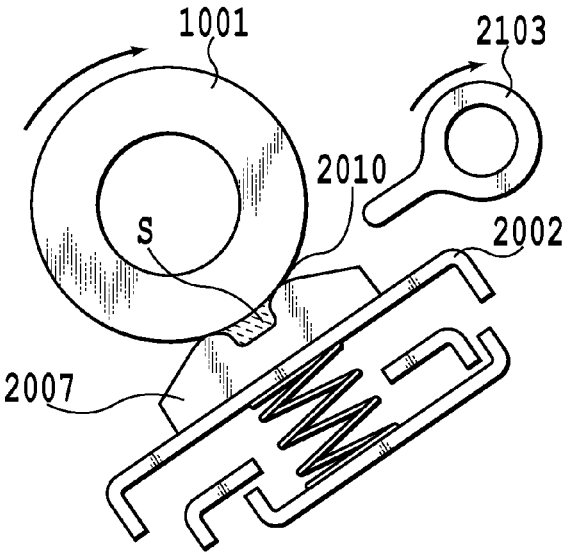

Next, after once stopping the coating roller 1001, the coating roller 1001 is rotated in a forward rotational direction. When the coating roller 1001 once again rotates in the forward rotational direction, as shown in FIG. 16C, the separate arm 2103 rotates in association with the forward rotational operation of the coating roller 1001 to be back to a position away from the coating cap 2002. In the halfway of this operation, the pressing force from the separate arm 2103 to the coating cap 2002 is gradually weakened, and the pressing force to the coating cap 2002 is released over time to separate the separate arm 2103 from the coating cap 2002. Thereby the upper edge portion 2010 of the contacting member 2007 is once again in contact with the peripheral surface of the coating roller 1001 to seal the liquid retaining space S. As a drive source of the separate arm 2103, the same drive source with the coating roller 1001 may be used to be connected to the coating roller 1001 by a gear. In addition, a drive motor for exclusive use different from the drive source of the coating roller 1001 may be used.

According to the arrangement of the present embodiment, without depending on a rotational speed or a rotational amount of the coating roller 1001, it is easy to adjust a separate amount and a separating time between the upper edge portion 2010 of the contacting member 2007 and the coating roller 1001.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-121159, filed May 19, 2009 which is hereby incorporated by reference herein in its entirety.

What is claimed is:

1. A liquid application mechanism comprising:

a coating roller; and a member contacting with the coating roller to form a space retaining a liquid between the member and the coating roller, wherein a medium is conveyed by rotating the coating roller in a first direction to apply the liquid reserved in the space on the medium, and wherein the liquid application mechanism includes a mechanism for separating at least a part of the member from the coating roller, and in a state where at least a part of the member is separated from the coating roller by the mechanism, the coating roller is rotated in a second direction as a reverse direction to the first direction, and the rotating in the second direction enable to pull out the liquid from the space onto the coating roller.

2. A liquid application mechanism according to claim 1, wherein in a state that the portion of the member at the downstream side is separated from the coating roller by the mechanism and a portion of the member in an upstream side thereof is in contact with the coating roller, the coating roller is rotated in the second direction.

3. A liquid application mechanism according to claim 1, wherein after rotating the coating roller in the second direction, by rotating the coating roller in the first direction in a state where the member and the coating roller are in contact with each other by interrupting the separation therebetween, a liquid reservoir can be formed in the periphery of a contacting position between the coating roller and the member.

4. A liquid application mechanism according to claim 1, wherein the mechanism includes a cam provided coaxially with the coating roller and a cam follower provided in the same position reference with the member, wherein the cam rotates with rotation of the coating roller in the second direction to push the cam follower, thereby separating at least the part of the member from the coating roller.

5. A liquid application mechanism according to claim 4, wherein the cam is provided coaxially with the coating roller through a one-way clutch, and when the coating roller rotates in the first direction, the cam rotates runs idle to the coating roller and when the coating roller rotates in the second direction, the cam rotates with the coating roller, by a function of the one-way clutch.

6. A liquid application mechanism according to claim 1, wherein a rotational amount of the coating roller in the second direction and a separate amount for separating the member from the coating roller are adjusted corresponding to the medium.

7. A liquid application mechanism according to claim 1, wherein a rotational amount of the coating roller in the second direction and a separate amount for separating the member from the coating roller are adjusted corresponding to an elapse time from the previous application operation.

8. An inkjet printing apparatus comprising:

the liquid application mechanism according to claim 1; and printing means for printing an image on the medium by ejecting ink from a print head to the medium on which the liquid is applied by the liquid application mechanism.

9. A method for controlling a liquid application mechanism, the liquid application mechanism comprising:

a coating roller; and a member contacting with the coating roller to form a space retaining a liquid between the member and the coating roller, wherein a medium is conveyed by rotating the coating roller in a first direction to apply the liquid reserved in the space on the medium, and the method comprising the steps of:

rotating the coating roller in a second direction as a reverse direction to the first direction in a state of separating at least a part of member from the coating roller to pull out the liquid from the space onto the coating roller; and after the above step, rotating the coating roller in the first direction in a state where the member and the coating roller are in contact with each other by interrupting the separation therebetween to reserve the liquid pulled by the above step in the periphery in a contacting position between the coating roller and the member and form a liquid reservoir.

* * * * *